US007390273B2

(12) United States Patent
Ohama et al.

(10) Patent No.: US 7,390,273 B2
(45) Date of Patent: Jun. 24, 2008

(54) GOLF BALL

(75) Inventors: Keiji Ohama, Kobe (JP); Kazuhiko Isogawa, Kobe (JP); Kazuya Kamino, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/822,517

(22) Filed: Jul. 6, 2007

(65) Prior Publication Data

US 2008/0045360 A1 Feb. 21, 2008

(30) Foreign Application Priority Data

Aug. 16, 2006 (JP) ..... 2006-221753
Aug. 16, 2006 (JP) ..... 2006-221766

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,729,861 A 3/1988 Lynch et al.
4,813,677 A 3/1989 Oka et al.
4,936,587 A 6/1990 Lynch et al.
5,080,367 A 1/1992 Lynch et al.
5,292,132 A 3/1994 Oka
5,782,707 A * 7/1998 Yamagishi et al. ..... 473/374
6,319,154 B1 11/2001 Yoshida et al.
7,195,570 B2 * 3/2007 Hanada et al. ..... 473/383
2005/0130768 A1 6/2005 Yokota et al.

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a core 4, a cover 6 and numerous dimples 8. The cover 6 has a thickness of less than 3.0 mm and a hardness H4 of equal to or greater than 90. A difference (H2–H1) of a surface hardness H2 of the core 4 and a central hardness H1 of the core 4 is 10 or greater and 25 or less. A difference (H4–H1) of the hardness H4 of the cover 6 and a surface hardness H1 of the core 4 is equal to or greater than 25. A difference (H4–H2) of the hardness H4 of the cover 6 and a surface hardness H2 of the core 4 is 10 or greater and 20 or less. Provided that mean diameter of all the dimples 8 is Da, a ratio (N1/N) of number N1 of adjacent dimple pairs having a pitch of (Da/4) or less to total number N of the dimples 8 is equal to or greater than 2.70. A ratio (N2/N1) of number N2 of adjacent dimple pairs having a pitch of (Da/20) or less to the number N1 is equal to or greater than 0.50.

13 Claims, 17 Drawing Sheets

GOLF BALL

This application claims priorities on Patent Application No. 2006-221753 and Patent Application No. 2006-221766 filed in JAPAN on Aug. 16, 2006. The entire contents of these Japanese Patent Applications are hereby incorporated by reference.

BACKGROUND OF THE INVENTION

1. Field of the Invention

The present invention relates to golf balls having a core, a cover and dimples.

2. Description of the Related Art

For golf balls, flight performance is important. Flight performance depends on aerodynamic characteristic of the golf ball. Aerodynamic characteristic heavily depends on specifications of dimples. The dimples disrupt the air flow around the golf ball during flight to cause turbulent flow separation. By causing the turbulent flow separation, separating points of the air from the golf ball shift backwards leading to the reduction of drag. The turbulent flow separation prolongs the gap between the separating point on the upper side and the separating point on the lower side of the golf ball, which results from the backspin, thereby the lift force that acts upon the golf ball is enhanced. Reduction in drag and elevation of lift force are referred to as "dimple effect". Excellent dimples disturb the air flow more efficiently. Owing to the excellent dimples, great flight distance can be achieved.

It is known to persons skilled in the art that a great dimple effect is achieved according to golf balls having the dimples densely arranged. Some proposals have been made in connection with dimple pattern aiming at improvement of the dimple effect.

JP-A-50-8630 (U.S. Pat. Nos. 4,729,861, 4,936,587 and 5,080,367) discloses a golf ball provided with numerous dimples having a uniform size. In this golf ball, pitch is smaller than 0.065 inch for most of the dimple pairs. According to this golf ball, relationship between the pitch and dimple diameter is not considered. In comparison with general dimple diameter, the pitch of 0.065 inch is not small enough. According to the pattern of the dimples having a uniform size, the diameter can not be set to be great. The dimples in this golf ball are not arranged densely enough.

JP-A-62-192181 (U.S. Pat. No. 4,813,677) discloses a golf ball provided with large dimples and small dimples. In this golf ball, high dimple density is achieved by arranging small dimples in the region surrounded by multiple large dimples. However, the small dimples are not sufficiently responsible for the dimple effect.

JP-A-4-347177 (U.S. Pat. No. 5,292,132) discloses a golf ball having the dimples arranged so that any rectangle having a predetermined size can not be formed on the land. In this golf ball, small proportion of the land is achieved by arranging many small dimples. However, the small dimples are not sufficiently responsible for the dimple effect.

Flight performance also depends on deformation behavior of golf balls. Golf balls which are greatly deformed when being hit by a driver are excellent in resilience performance. Owing to the excellent resilience performance, great flight distance is obtained. When golf balls whose rigidity in shear direction is great are hit by a club, spin rate of the golf balls is low. Owing to the low spin rate, great flight distance is obtained. Especially when golf balls are hit by an iron club, spin rate heavily depends on rigidity in shear direction. In light of flight performance, proposals concerning improvement of the structure and materials of golf balls have been made.

The golf players place great importance also on spin performance of the golf balls. Great back spin rate results in small run. For golf players, golf balls which are liable to be spun backwards are apt to be rendered to stop at a targeted position. With high side spin rate, trajectory of the golf ball is easily curved. For golf players, golf balls which are liable to be spun sidewise are apt to allow their trajectory to curve intentionally. The golf balls that are excellent in spin performance are excellent in control performance. High class golf players particularly place great importance on control performance upon shots with a short iron. In light of flight performance and control performance, some proposals concerning improvement of structure and material of the golf ball have been made.

JP-A-9-239068 (U.S. Pat. No. 5,782,707) discloses a golf ball having a core, a mid layer and a cover whose hardness is less than that of the mid layer. In this golf ball, the cover deteriorates resilience performance. In this golf ball, spin rate is high when the golf ball is hit by an iron club. This golf ball is inferior in flight performance.

JP-A-2005-168701 (US Publication No. 2005/130768) discloses a golf ball having a cover which includes thermoplastic elastomers. This golf ball has large dimples. In this golf ball, the cover deteriorates resilience performance. In this golf ball, high spin rate is obtained when the golf ball is hit by an iron club. In this golf ball, there is room for improvement of the dimple pattern.

JP-A-2001-145709 (U.S. Pat. No. 6,319,154) discloses a golf ball having a core with predetermined hardness and a cover with predetermined hardness. In this golf ball, high spin rate is obtained when the golf ball is hit by a driver. This golf ball is inferior in flight performance.

Concern of golf players for golf balls is their flight distance and control performance. In light of flight performance, there is room for improvement of golf balls. An object of the present invention is to provide a golf ball that is excellent in flight performance. A further object of the present invention is to provide a golf ball that is excellent in control performance.

SUMMARY OF THE INVENTION

A golf ball according to the present invention has a core, a cover covering this core and numerous dimples formed on the surface thereof. This cover has a thickness of less than 3.0 mm and a hardness H4 of equal to or greater than 90. A difference (H2−H1) between a surface hardness H2 of the core and a central hardness H1 of the core is 10 or greater and 25 or less. A difference (H4−H1) between the hardness H4 of the cover and the central hardness H1 of the core is equal to or greater than 25. A difference (H4−H2) between the hardness H4 of the cover and the surface hardness H2 of the core is 10 or greater and 20 or less. Provided that mean diameter of all the dimples is Da, ratio (N1/N) of number N1 of adjacent dimple pairs having a pitch of (Da/4) or less to total number N of the dimples is equal to or greater than 2.70. Ratio (N2/N1) of number N2 of the adjacent dimple pairs having a pitch of (Da/20) or less to the number N1 is equal to or greater than 0.50.

In this golf ball, an outer side has great rigidity and an inner side is soft. This golf ball shows proper deformation behavior. This golf ball is excellent in resilience performance. This golf ball has low spin rate. Further, dimples on this golf ball reduce drag and generate lift force meted with to launch angles. In this golf ball, a proper trajectory is obtained. Owing to synergistic effect of proper deformation behavior and excellent aerodynamic characteristics, great flight distance is obtained with this golf ball.

Preferably, base polymer for the cover contains an ionomer resin as a principal component and a thermoplastic elastomer having material hardness (JIS-A) of less than 25. Proportion of the thermoplastic elastomer in the total base polymer is 1% by weight or greater and 30% by weight or less.

A golf ball according to another aspect of the present invention has a core, a cover including an outer cover and numerous dimples formed on the surface of the outer cover. This outer cover has a hardness H4 of less than 90. The cover has a thickness of 2.2 mm or less. A difference (H2−H1) between a surface hardness H2 of the core and a central hardness H1 of the core is 10 or greater and 25 or less. Sum (H2+H5) of the surface hardness H2 of the core and a surface hardness H5 of the golf ball is 150 or greater and 180 or less.

Provided that mean diameter of all the dimples is Da, ratio (N1/N) of number N1 of adjacent dimple pairs having a pitch of (Da/4) or less to total number N of the dimples is equal to or greater than 2.70. Ratio (N2/N1) of number N2 of the adjacent dimple pairs having a pitch of (Da/20) or less to the number N1 is equal to or greater than 0.50.

In this golf ball, by exercising ingenuity on hardness distribution, surface hardness and thickness of the cover, proper deformation behavior on a driver shot or an iron shot is obtained. Further, in this golf ball, the dimples reduce drag and generate lift force meted with launch angles. In this golf ball, a proper trajectory is obtained. This golf ball is excellent in flight performance and control performance.

Preferably, the outer cover has a thickness of less than 0.8 mm and a hardness H4 of less than 80. The cover may further have an inner cover which is positioned inward of the outer cover. The inner cover has a thickness of equal to or less than 1.6 mm. This inner cover has a hardness H3 of equal to or greater than 90.

Preferably, the ratio (N2/N1) is equal to or greater than 0.60. Preferably, the mean diameter Da is equal to or greater than 4.00 mm. Preferably, total number N of the dimples is equal to or less than 362. Preferably, proportion of total are a of all the dimples to surface are a of a phantom sphere of the golf ball is equal to or greater than 75%.

Preferably, the northern hemisphere and the southern hemisphere of the surface of this golf ball have a pole vicinity region, an equator vicinity region and a coordination region, respectively. This coordination region is located between the pole vicinity region and the equator vicinity region. The dimple pattern in the pole vicinity region includes multiple units. These units are rotationally symmetric to each other centered on the pole point. The dimple pattern in the equator vicinity region includes multiple units. These units are rotationally symmetric to each other centered on the pole point. Number of the units in the pole vicinity region is different from number of the units in the equator vicinity region. The dimple pattern in the coordination region is either a pattern which cannot be comparted into multiple units that are rotationally symmetric to each other centered on the pole point, or a pattern including multiple units that are rotationally symmetric to each other centered on the pole point with number of the units being different from the numbers of the units in the pole vicinity region and the equator vicinity region. It is preferred that the surface of this golf ball does not have any great circle which does not cross the dimple.

In the present invention, the hardness H1, H2, H3, H4 and H5 are measured by a JIS-C type spring hardness scale.

DESCRIPTION OF THE PREFERRED EMBODIMENTS

Hereinafter, the present invention will be described in detail according to the preferred embodiments with appropriate references to the accompanying drawing.

Figure 1:
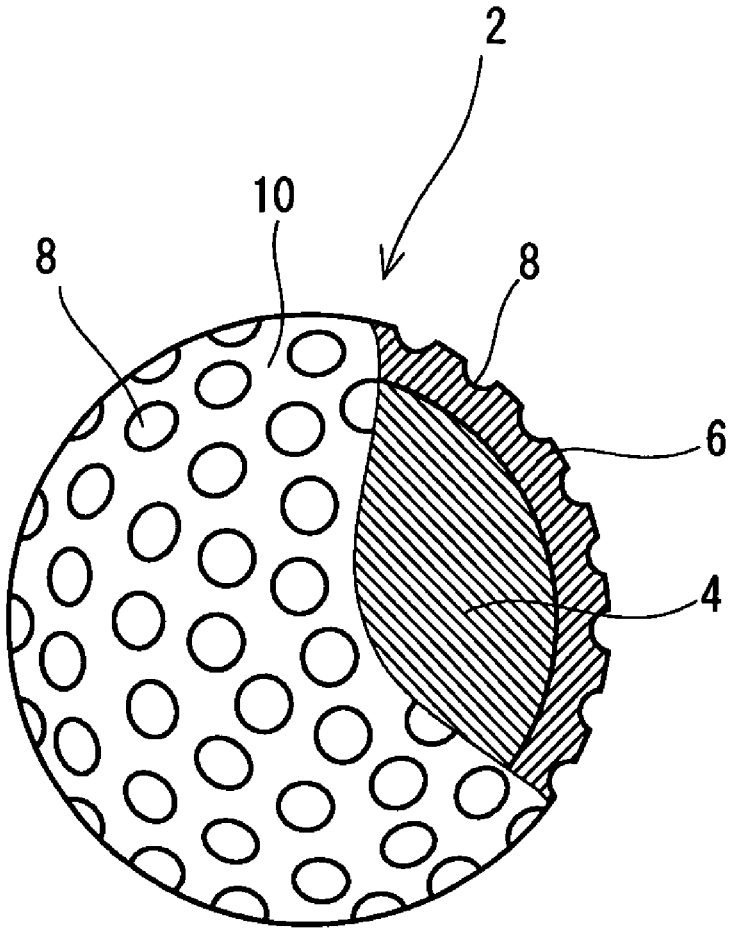
FIG. 1 shows a schematic cross-sectional view illustrating a golf ball according to one embodiment of the present invention.

Golf ball 2 shown in FIG. 1 has a spherical core 4 and a cover 6 covering this core 4. On the surface of the cover 6, numerous dimples 8 are formed. Of the surface of the golf ball 2, a part except for the dimples 8 is a land 10. This golf ball 2 has a paint layer and a mark layer to the external side of the cover 6 although these layers are not shown in the Figure.

This golf ball 2 has a diameter of 40 mm or greater and 45 mm or less. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is more preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. In light of resilience performance, polybutadienes are preferred. When other rubber is used in combination with a polybutadiene, it is preferred that polybutadiene is included as a principal component. Specifically, a proportion of polybutadiene in the entire base rubber is preferably equal to or greater than 50% by weight, and particularly preferably equal to or greater than 80% by weight. A polybutadiene having a proportion of cis-1,4 bonds of equal to or greater than 40 mol %, and further, equal to or greater than 80 mol % is preferred.

A polybutadiene synthesized using a rare earth element catalyst is particularly preferred. By using this polybutadiene, excellent resilience performance of the golf ball 2 can be achieved. Examples of rare earth element catalysts include a lanthanum series rare earth element compound, an organoaluminum compound, and a compound containing almoxane and halogen. A lanthanum series rare earth element compound is preferred. Examples of lanthanum series rare earth element compounds include holide, carboxylate, alcoholate, thioalcoholate and amide of lanthanide having atomic numbers from 57 to 71. Neodymium catalyst (catalyst containing neodymium compound) is particularly preferred. When polymerizing, a molar ratio of a butadiene to a lanthanum series rare earth element compound is preferably equal to or greater than 1000/1, more preferably equal to or greater than 5000/1. The molar ratio is preferably equal to or less than 2000000/1, more preferably equal to or less than 1000000/1.

It is preferred that polybutadienes synthesized using a rare earth element catalyst are further denatured by a compound having an alkoxysilyl group. The denatured polybutadienes have a proportion of cis-1,4 bonds of equal to or greater than 90 mol %. By this denatured polybutadienes, excellent resilience performance of the golf ball 2 is achieved.

Examples of compounds having an alkoxysilyl group include an alkoxysilane containing an epoxy group and an alkoxysilane compound containing an isocyanate group. Specific examples of the alkoxysilane containing the epoxy group include 3-glycidiloxypropyltrimethoxysilane, 3-glycidiloxypropyltriethoxysilane, (3-glycidiloxypropyl)methyldimethoxysilane, (3-glycidiloxypropyl)methyldiethoxysilane, β-(3,4-epoxycyclohexyl)trimethoxysilane, β-(3,4-epoxycyclohexyl)triethoxysilane, β-(3,4-epoxycyclohexyl)methyldimethoxysilane, β-(3,4-epoxycyclohexyl)ethyldimethoxysilane, a condensate of 3-glycidiloxypropyltrimethoxysilane, and a condensate of (3-glycidiloxypropyl)methyldimethoxysilane. Specific examples of alkoxysilane compounds containing isocyanate group include 3-isocyanatepropyltrimethoxysilane, 3-isocyanatepropyltriethoxysilane, (3-isocyanatepropyl)methyldimethoxysilane, (3-isocyanatepropyl)methyldiethoxysilane, a condensate of 3-isocyanatepropyltrimethoxysilane, and a condensate of (3-isocyanatepropyl)methyldimethoxysilane.

This denatured polybutadiene has a ratio (Mw/Mn) of weight average molecular weight Mw and number average molecular weight Mn of 1.0 to 3.5, particularly 1.0 to 3.3. This denatured polybutadiene has a mooney viscosity $ML_{1+4}$ (100° C.) of 30 to 100, particularly 50 to 90.

A rubber composition for the core 4 includes a co-crosslinking agent. Preferable examples of the co-crosslinking agent in light of the resilience performance include monovalent or bivalent metal salts of an α, β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α, β-unsaturated carboxylic acid include acrylic acid and methacrylic acid. Examples of preferable metal oxide include zinc oxide and magnesium oxide.

The amount of the co-crosslinking agent to be blended is preferably 10 parts by weight or greater and 50 parts by weight or less per 100 parts by weight of the base rubber. By setting the amount to be equal to or greater than 10 parts by weight, excellent resilience performance can be achieved. In this respect, the amount is more preferably equal to or greater than 15 parts by weight and particularly preferably equal to or greater than 20 parts by weight. By setting the amount to be equal to or less than 50 parts by weight, excellent feel at impact can be achieved. In this respect, the amount is more preferably equal to or less than 45 parts by weight and particularly preferably equal to or less than 35 parts by weight.

Preferably, the rubber composition of the core 4 includes an organic peroxide together with the co-crosslinking agent. The organic peroxide serves as a crosslinking initiator. The organic peroxide is responsible for resilience performance. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. By setting the amount to be equal to or greater than 0.1 part by weight, excellent resilience performance can be achieved. In this respect, the amount is more preferably equal to or greater than 0.3 part by weight, and particularly preferably equal to or greater than 0.5 part by weight. By setting the amount to be equal to or less than 3.0 parts by weight, excellent feel at impact can be achieved. In this respect, the amount is more preferably equal to or less than 2.8 parts by weight, and particularly preferably equal to or less than 2.5 parts by weight.

Preferably, the rubber composition of the core 4 includes an organic sulfur compound. By the organic sulfur compound, excellent resilience performance of the golf ball 2 can be achieved. Illustrative examples of preferable organic sulfur compound include monosubstitution such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; disubstitution such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; trisubstitution such as bis(2,4,6-trichlorophenyl)disulfide and bis(2-cyano-4-chloro-6-bromophenyl)disulfide; tetrasubstitution such as bis(2,3,5,6-tetrachlorophenyl)disulfide; and pentasubstitution such as bis(2,3,4,5,6-pentachlorophenyl)disulfide and bis(2,3,4,5,6-pentabromophenyl)disulfide. Particularly preferable organic sulfur compound is diphenyl disulfide and bis(pentabromophenyl)disulfide.

In light of resilience performance of the golf ball 2, the amount of the organic sulfur compound to be blended is preferably equal to or greater than 0.01 part by weight, more preferably equal to or greater than 0.05 part by weight and particularly preferably equal to or greater than 0.1 part by weight per 100 parts by weight of the base rubber. In light of soft feel at impact, the amount of the organic sulfur compound to be blended is preferably equal to or less than 5 parts by weight, more preferably equal to or less than 4 parts by weight, and particularly preferably equal to or less than 3 parts by weight per 100 parts by weight of the base rubber.

Into the core 4 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler to be blended is determined ad libitum so that the intended specific gravity of the core 4 can be accomplished. Particularly preferable filler is zinc oxide. Zinc oxide serves not only to adjust the specific gravity but also as a crosslinking activator. Various kinds of additives such as sulfur, an anti-aging agent, a coloring agent, a plasticizer, a dispersant and the like may be blended at an adequate amount to the core 4 as needed. Into the core 4 may be also blended crosslinked rubber powder or synthetic resin powder.

The core 4 has a central hardness H1 of preferably 45 or greater and 70 or less. By the core 4 having the central hardness H1 of equal to or greater than 45, excellent resilience performance can be achieved. In this respect, the central hardness H1 is more preferably equal to or greater than 50, and particularly preferably equal to or greater than 55. The core 4 having the central hardness H1 of equal to or less than 70 suppresses spin of the golf ball 2. By the suppression of the spin, great flight distance can be achieved. In this respect, the central hardness H1 is particularly preferably equal to or less than 65. The central hardness H1 is measured by pressing a JIS-C type spring hardness scale on a central point of a hemisphere obtained by cutting the golf ball 2. For the measurement, an automated rubber hardness tester (trade name "P1", available from Koubunshi Keiki Co., Ltd.) which is equipped with this hardness scale is used.

The core 4 has a surface hardness H2 of preferably 65 or greater and 90 or less. By the core 4 having the surface hardness H2 of equal to or greater than 65, excellent resilience performance can be achieved. In this respect, the surface hardness H2 is more preferably equal to or greater than 70, and particularly preferably equal to or greater than 75. By the core 4 having the surface hardness H2 of equal to or less than 90, excellent feel at impact can be achieved. In this respect, the surface hardness H2 is more preferably equal to or less than 85. The surface hardness H2 is measured by pressing the JIS-C type spring hardness scale against the surface of the core 4. For the measurement, the automated rubber hardness tester (trade name "P1", available from Koubunshi Keiki Co., Ltd.) which is equipped with this hardness scale is used.

A difference (H2−H1) between the surface hardness H2 and the central hardness H1 is preferably 10 or greater and 25 or less. The core 4 having the difference (H2−H1) of equal to or greater than 10 is sufficiently deformed when being hit. By the sufficient deformation, spin can be suppressed. In this respect, the difference (H2−H1) is more preferably equal to or greater than 12, and particularly preferably equal to or greater than 14. The core 4 having the difference (H2−H1) of equal to or less than 25, excellent resilience performance can be achieved. In this respect, the difference (H2−H1) is more preferably equal to or less than 20, and still more preferably equal to or less than 18, and particularly preferably equal to or less than 16.

The amount of compressive deformation of the core 4 is preferably 3.0 mm or greater and 5.0 mm or less. By the core 4 having the amount of compressive deformation of equal to or greater than 3.0 mm, low spin rate and excellent feel at impact can be achieved. In this respect, the amount of compressive deformation is more preferably equal to or greater than 3.4 mm and particularly preferably equal to or greater than 3.8 mm. As described later, the cover 6 of this golf ball 2 is thin. Owing to the core 4 having the amount of compressive deformation of equal to or less than 5.0 mm, excellent resilience performance can be achieved. In this respect, the amount of compressive deformation is more preferably equal to or less than 4.8 mm, and particularly preferably equal to or less than 4.5 mm.

Upon measurement of the amount of compressive deformation, the spherical body (core 4 or golf ball 2) is first placed on a hard plate made of metal. Next, a cylinder made of metal gradually descends toward the spherical body. The spherical body intervened between the bottom face of the cylinder and the hard plate is deformed. A migration distance of the cylinder, starting from the state in which initial load of 98 N is applied to the spherical body up to the state in which final load of 1274 N is applied thereto is the amount of compressive deformation.

The core 4 has a diameter of preferably 38.6 mm or greater and 40.8 mm or less. The core 4 having a diameter of equal to or greater than 38.6 mm is sufficiently deformed when the golf ball 2 is hit by a driver. By the sufficient deformation, spin on a driver shot can be suppressed. In this respect, the diameter is more preferably equal to or greater than 39.0 mm, and particularly preferably equal to or greater than 39.4 mm. The core 4 having a diameter of equal to or less than 40.8 mm can suppress spin when the golf ball 2 is hit by an iron club. In this respect, the diameter is more preferably equal to or less than 40.4 mm, and particularly preferably equal to or less than 4.02 mm.

The weight of the core 4 is preferably 35.0 g or greater and 44.5 g or less. Crosslinking temperature of the core 4 is usually 140° C. or greater and 180° C. or less. The crosslinking time period of the core 4 is usually 10 minutes or longer and 60 minutes or less. By crosslinking under relatively high temperature and for relatively short time, the core 4 which has the difference (H2−H1) being within the above range can be obtained. The core may have two or more layers.

The cover 6 is formed by a thermoplastic resin composition. Examples of the base polymer of this resin composition include ionomer resins, styrene block-containing thermoplastic elastomers, thermoplastic polyester elastomers, thermoplastic polyamide elastomers, thermoplastic polyurethane elastomers and thermoplastic polyolefin elastomers. In particular, ionomer resins are preferred. The ionomer resins are highly elastic. By using the ionomer resins, excellent resilience performance of the golf ball 2 can be achieved.

Examples of preferred ionomer resin include binary copolymers formed with α-olefin and an α,β-unsaturated carboxylic acid having 3 to 8 carbon atoms. Preferable binary copolymer comprises 80% by weight or more and 90% by weight or less α-olefin, and 10% by weight or more and 20% by weight or less α, β-unsaturated carboxylic acid. This binary copolymer provides excellent resilience performance. Examples of preferable other ionomer resin include ternary copolymers formed with α-olefin, an α, β-unsaturated carboxylic acid having 3 to 8 carbon atoms and an α, β-unsaturated carboxylate ester having 2 to 22 carbon atoms. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. In the binary copolymer and ternary copolymer, preferable α-olefin may be ethylene and propylene, while preferable α,β-unsaturated carboxylic acid may be acrylic acid and methacrylic acid. Particularly preferred ionomer resin is a copolymer formed with ethylene, and acrylic acid or methacrylic acid.

In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of resilience performance and durability of the golf ball 2 is sodium ion, zinc ion, lithium ion and magnesium ion.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329" and "Himilan MK7320", available from Du Pont-MITSUI POLYCHEMICALS Co., Ltd.; trade names "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945" and "Surlyn® AD8546", available from Dupont; and trade names "IOTEK 7010", "IOTEK 7030", "IOTEK 7510", "IOTEK 7520", "IOTEK 8000" and "IOTEK 8030", available from EXXON Mobil Chemical Corporation. Two or more kinds of the ionomer resin may be used in combination. An ionomer resin neutralized with a monovalent metal ion, and an ionomer resin neutralized with a bivalent metal ion may be used in combination.

Preferably, an ionomer resin having a material hardness (Shore D) of 50 or greater and 70 or less is used. The ionomer resin having the material hardness of equal to or greater than 50 is responsible for resilience performance of the golf ball 2. In light of resilience performance, the ionomer resin has the material hardness of more preferably equal to or greater than 53, and particularly preferably equal to or greater than 55. The ionomer resin having the material hardness of equal to or less than 70 is responsible for feel at impact of the golf ball 2. In light of feel at impact, the ionomer resin has the material hardness of more preferably equal to or less than 67, and particularly preferably equal to or less than 65.

The material hardness of ionomer resins are measured in accordance with a standard of "ASTM-D 2240-68". For the measurement, an automated rubber hardness tester (trade name "P1", available from Koubunshi Keiki Co., Ltd.) which is equipped with a Shore D type hardness scale is used. For the measurement, a sheet which is formed by hot press and has a thickness of about 2 mm is used. Prior to the measurement, the sheet is stored at a temperature of 23° C. for two weeks. When the measurement is carried out, three sheets are overlaid. For the measurement, sheets formed only by ionomer resin are used.

The ionomer resin and other resin may be used in combination. When they are used in combination, the ionomer resin is included as a principal component of the base polymer, in light of resilience performance. A proportion of the ionomer resin in the total base polymer accounts for preferably equal to or greater than 70% by weight, more preferably equal to or greater than 80% by weight, and particularly preferably equal to or greater than 85%.

In light of excellent compatibility with the ionomer resin, it is preferable that the styrene block-containing thermoplastic elastomer is used in combination. The styrene block-containing thermoplastic elastomer is responsible for feel at impact and strength of the golf ball 2. The styrene block-containing thermoplastic elastomer includes a polystyrene block as a hard segment, and a soft segment. Typical soft segment is a diene block. Illustrative examples of diene compounds include butadiene, isoprene, 1,3-pentadiene and 2,3-dimethyl-1,3-butadiene. Butadiene and isoprene are preferred. Two or more compounds may be used in combination.

Examples of the styrene block-containing thermoplastic elastomer include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS may include styrene-ethylene-butylene-styrene block copolymers (SEBS). Exemplary hydrogenated SIS may include styrene-ethylene-propylene-styrene block copolymers (SEPS). Exemplary hydrogenated SIBS may include styrene-ethylene-ethylene-propylene-styrene block copolymers (SEEPS).

In light of resilience performance of the golf ball 2, content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomer may include alloys of olefin and one or two or more selected from the group consisting of SBS, SIS, SIBS, SEBS, SEPS and SEEPS, and hydrogenated products thereof. Olefin component in the alloy is presumed to contribute to the improvement of compatibility with ionomer resins. Use of this alloy may improve resilience performance of the golf ball 2. Preferably, an olefin having 2 to 10 carbon atoms may be used. Illustrative examples of suitable olefin include ethylene, propylene, butane and pentene. Ethylene and propylene are particularly preferable.

Specific examples of polymer alloys include "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon®SJ9400N" and "Rabalon®SR04", tradenames by Mitsubishi Chemical Corporation. Other specific examples of the styrene block-containing thermoplastic elastomer include "Epofriend® A1010", a trade name by Daicel Chemical Industries; and "Septon HG-252", a trade name by Kuraray Co., Ltd.

Preferably, styrene block-containing thermoplastic elastomer having a material hardness (JIS-A) of less than 25 is used. This elastomer can be responsible for feel at impact even if the amount to be blended is small. By using this elastomer, ionomer resin to be blended into the cover 6 can be high propotion. By using this elastomer, both resilience performance and feel at impact of the golf ball 2 can be achieved. In this respect, the material hardness is more preferably less than 23, still more preferably less than 20, and particularly preferably less than 18. The material hardness is preferably equal to or greater than 3.

The material hardness of the styrene block-containing thermoplastic elastomer is measured by an automated rubber hardness tester (trade name "P1", available from Koubunshi Keiki Co., Ltd.) which is equipped with a JIS-A type hardness scale. For the measurement, a sheet which is formed by hot press and has a thickness of about 2 mm is used. Prior to the measurement, the sheet is stored at a temperature of 23° C. for two weeks. When the measurement is carried out, three sheets are overlaid. For the measurement, sheets formed only by this elastomer are used.

The material hardness of the styrene block-containing thermoplastic elastomer measured by the Shore D type hardness scale is preferably less than 9, more preferably less than 8, still more preferably less than 7, and particularly preferably less than 6.

In light of feel at impact, a proportion of the styrene block-containing thermoplastic elastomer in the total base polymer is preferably equal to or greater than 1% by weight, more preferably equal to or greater than 2% by weight, and particularly preferably equal to or greater than 3% by weight. In light of resilience performance, this proportion is preferably equal to or less than 30% by weight, more preferably equal to or less than 20% by weight, and particularly preferably equal to or less than 15% by weight.

The cover 6 has a hardness H4 of preferably equal to or greater than 90. By the cover 6 having a hardness H4 of equal to or greater than 90, excellent resilience performance can be achieved. In addition, this cover 6 can suppress spin. In these respects, the hardness H4 is more preferably equal to or greater than 92, and particularly preferably equal to or greater than 94. In light of feel at impact, the hardness H4 is preferably equal to or less than 97, and particularly preferably equal to or less than 95.

The hardness H4 of the cover 6 is measured by an automated rubber hardness tester (trade name "P1", available from Koubunshi Keiki Co., Ltd.) which is equipped with a JIS-C type hardness scale. For the measurement, a sheet which is formed by hot press and has a thickness of about 2 mm is used. Prior to the measurement, the sheet is stored at a temperature of 23° C. for two weeks. When the measurement is carried out, three sheets are overlaid. For the measurement, sheets formed by the same material as that of the cover 6 are used.

The cover may consist of two or more layers. In this instance, the aforementioned hardness H4 is defined as a hardness of the outermost layer. In the instance that the cover consists of two or more layers, the second layer from the outside has a hardness of preferably 30 or greater and 90 or less. The layer having a hardness of equal to or greater than 30 does not deteriorate resilience performance of the golf ball 2. In this respect, the hardness is particularly preferably equal to or greater than 40. The layer having a hardness of equal to or less than 90 can be responsible for feel at impact. In this respect, the hardness is more preferably equal to or less than 85, and particularly preferably equal to or less than 80.

The cover 6 has a thickness of preferably 0.5 mm or greater and less than 3.0 mm. The cover 6 having a thickness of equal to or greater than 0.5 mm can be responsible for durability of the golf ball 2. In this respect, the thickness is particularly preferably equal to or greater than 0.8 mm. By the cover 6 having a thickness of less than 3.0 mm, sufficient deformation of the core 4 is achieved when being hit by a driver. By the sufficient deformation, great resilience performance is achieved and spin is suppressed. In this respect, the thickness is more preferably less than 2.8 mm, and particularly preferably less than 2.4 mm. The thickness of the cover 6 is measured immediately below the land 10. In the instance that the cover consists of two or more layers, the total thickness of all layers is set to be within the range above.

In the instance that the cover consists of two or more layers, the outermost layer has a thickness of preferably 0.3 mm or greater and 1.6 mm or less. The layer having a thickness of equal to or greater than 0.3 mm can be responsible for control performance when the golf ball is hit by a short iron club. In this respect, the thickness is particularly preferably equal to or greater than 0.5 mm. The layer having a thickness of equal to or less than 1.6 mm does not deteriorate feel at impact of the golf ball 2. In this respect, the thickness is preferably equal to or less than 1.4 mm, and particularly preferably equal to or less than 1.2 mm.

In the instance that the cover consists of two or more layers, the second layer from the outside has a thickness of 0.3 mm or greater and 1.6 mm or less. The layer having a thickness of equal to or greater than 0.3 mm can be responsible for durability of the golf ball 2. In this respect, the thickness is particularly preferably equal to or greater than 0.5 mm. The layer having a thickness of equal to or less than 1.6 mm does not interfere deformation of the core 4. In this respect, the thickness is preferably equal to or less than 1.4 mm, and particularly preferably equal to or less than 1.2 mm.

A difference (H4−H1) between the hardness H4 of the cover 6 and the central hardness H1 of the core 4 is preferably 25 or greater and 50 or less. The golf ball 2 having the difference (H4−H1) of equal to or greater than 25 is sufficiently deformed when being hit by a driver. By the sufficient deformation, spin is suppressed. In this respect, the difference (H4−H1) is more preferably equal to or greater than 27, and particularly preferably equal to or greater than 30. The golf ball 2 having the difference (H4−H1) of equal to or less than 50 is excellent in resilience performance. In this respect, the difference (H4−H1) is particularly preferably equal to or less than 40.

A difference (H4−H2) between the hardness H4 of the cover 6 and the surface hardness H2 of the core 4 is preferably 10 or greater and 20 or less. When the golf ball 2 having the difference (H4−H2) of equal to or greater than 10 is hit by an iron club, spin can be suppressed. In this respect, the difference (H4−H2) is more preferably equal to or greater than 12, and particularly preferably equal to or greater than 14. When the golf ball 2 having the difference (H4−H2) of equal to or less than 20 is hit by a driver, energy loss caused when the golf ball 2 is deformed is suppressed. By the suppression of energy loss, excellent resilience performance can be achieved. In this respect, the difference (H4−H1) is preferably equal to or less than 18, and particularly preferably equal to or less than 16.

An amount of compressive deformation of the golf ball 2 is preferably 2.9 mm or greater and 4.0 mm or less. The golf ball 2 having the amount of compressive deformation of equal to or greater than 2.9 mm is excellent in feel at impact. In this respect, the amount of compressive deformation is particularly preferably equal to or greater than 3.0 mm. The golf ball 2 having the amount of compressive deformation of equal to or less than 4.0 mm is excellent in resilience performance. In this respect, the amount of compressive deformation is particularly preferably equal to or less than 3.8 mm.

Figure 2:
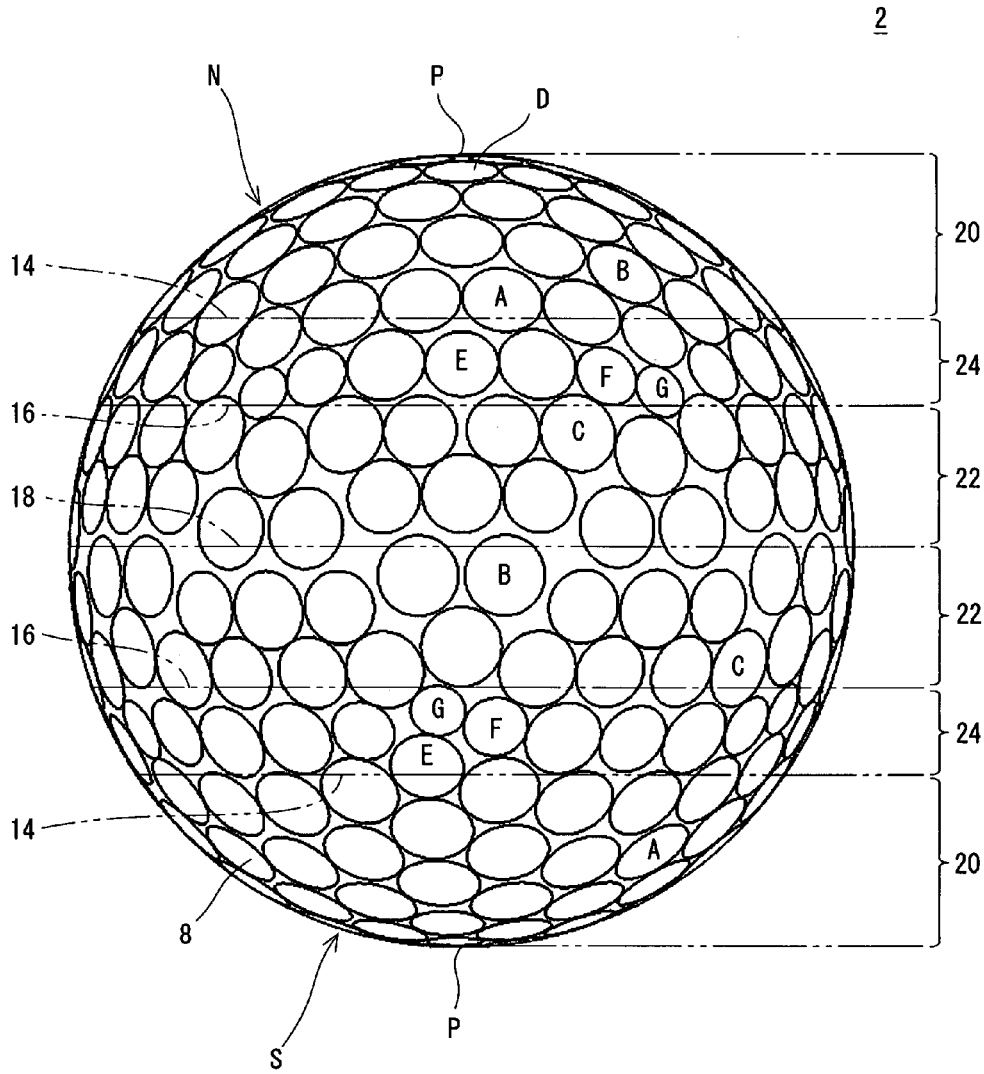
FIG. 2 shows an enlarged front view illustrating the golf ball shown in FIG. 1.

FIG. 2 shows an enlarged front view illustrating the golf ball 2 shown in FIG. 1. In FIG. 2, types of the dimples 8 are indicated by the reference signs A to G. All dimples 8 have a plane shape of circular. This golf ball 2 has dimples A having a diameter of 4.5 mm, dimples B having a diameter of 4.4 mm, dimples C having a diameter of 4.3 mm, dimples D having a diameter of 4.1 mm, dimples E having a diameter of 4.0 mm, dimples F having a diameter of 3.5 mm, and dimples G having a diameter of 3.0 mm. Number of the dimples A is 60; number of the dimples B is 86; number of the dimples C is 56; number of the dimples D is 10; number of the dimples E is 76; number of the dimples F is 22; and, number of the dimples G is 18. Total number of the dimples 8 is 328. Mean diameter Da is 4.16 mm.

Figure 3:
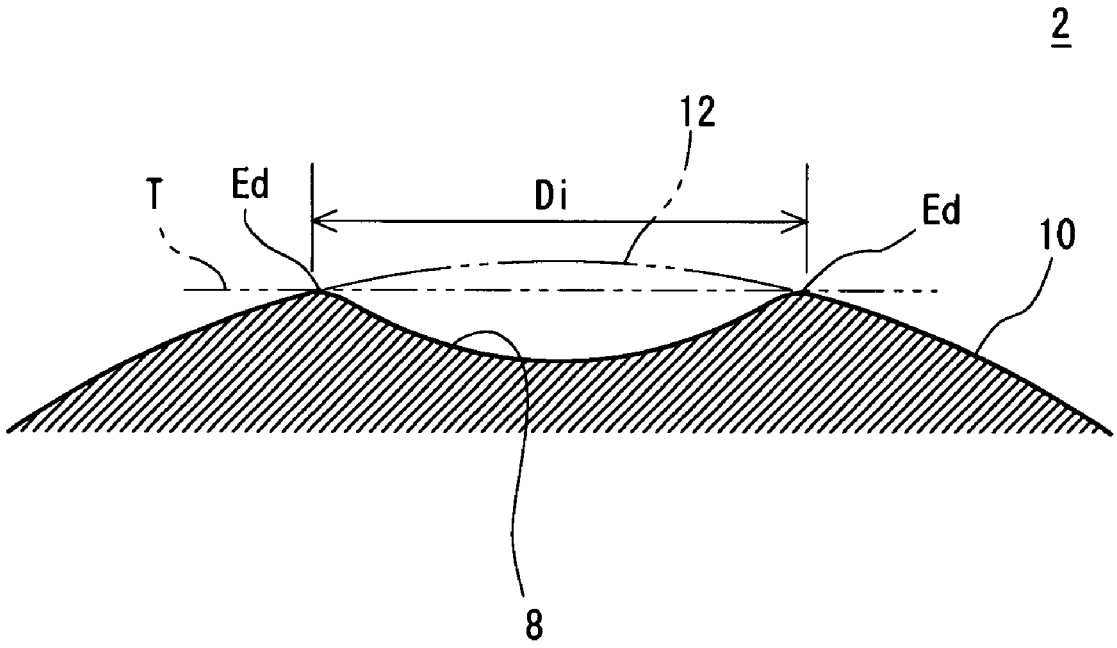
FIG. 3 shows an enlarged cross-sectional view illustrating a part of the golf ball shown in FIG. 1.

FIG. 3 shows an enlarged cross-sectional view illustrating a part of the golf ball 2 shown in FIG. 1. In this FIG. 3, a cross section along a plane passing through the center (deepest part) of the dimple 8 and the center of the golf ball 2 is shown. A top-to-bottom direction in FIG. 3 is an in-depth direction of the dimple 8. What is indicated by a chain double-dashed line 12 in FIG. 3 is a phantom sphere. The phantom sphere 12 corresponds to the surface of the golf ball 2 when it is postulated that there is no dimple 8 existed. The dimple 8 is recessed from the phantom sphere 12. The land 10 agrees with the phantom sphere 12.

In FIG. 3, what is indicated by a both-oriented arrowhead Di is the diameter of the dimple 8. This diameter Di is a distance between one contact point Ed and another contact point Ed, which are provided when a tangent line T that is common to both sides of the dimple 8 is depicted. The contact point Ed is also an edge of the dimple 8. The edge Ed defines the contour of the dimple 8. The diameter Di is preferably 2.00 mm or greater and 6.00 mm or less. By setting the diameter Di to be equal to or greater than 2.00 mm, great dimple effect can be achieved. In this respect, the diameter Di is more preferably equal to or greater than 2.20 mm, and particularly preferably equal to or greater than 2.40 mm. By setting the diameter Di to be equal to or less than 6.00 mm, fundamental feature of the golf ball 2 which is substantially a sphere is not deteriorated. In this respect, the diameter Di is more preferably equal to or less than 5.80 mm, and particularly preferably equal to or less than 5.60 mm.

Figure 4:
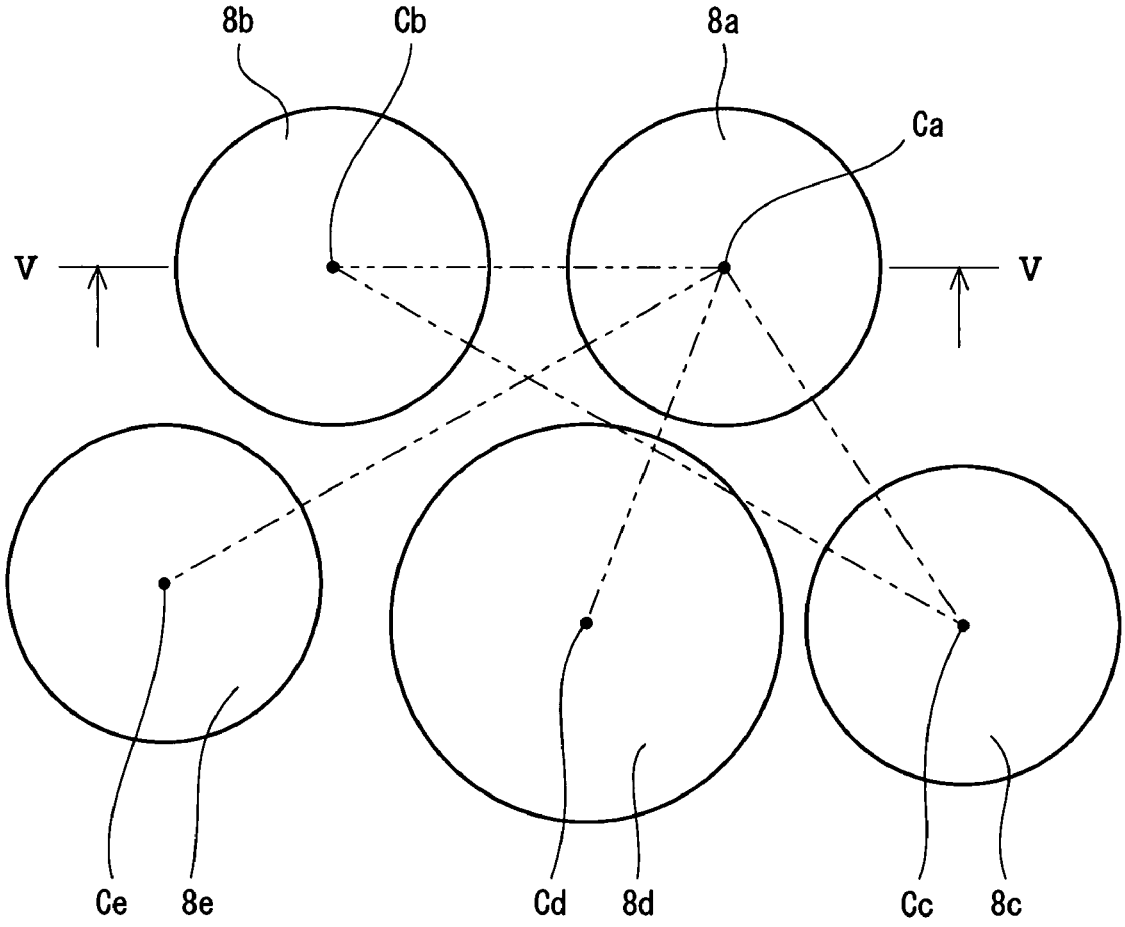
FIG. 4 shows an enlarged front view illustrating a part of the golf ball shown in FIG. 2.

FIG. 4 shows an enlarged front view illustrating a part of the golf ball 2 shown in FIG. 2. In this FIG. 4, dimple 8*a*, dimple 8*b*, dimple 8*c*, dimple 8*d* and dimple 8*e* are illustrated. A plane along a line V-V in FIG. 4 passes through the center of the dimple 8*a* and the center of the dimple 8*b*.

Figure 5:
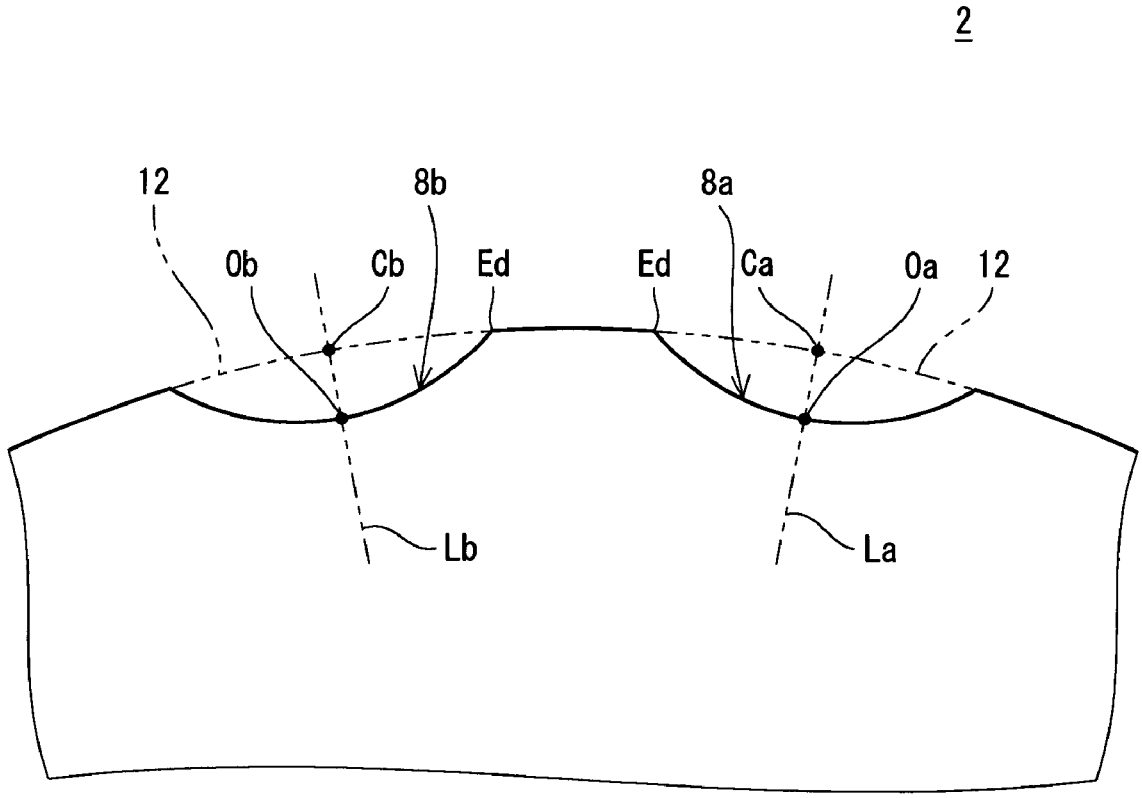
FIG. 5 shows a cross-sectional view taken along a line V-V of FIG. 4.

FIG. 5 shows a cross-sectional view taken along a line V-V of FIG. 4. In FIG. 5, what is indicated by reference sign Oa is the center of the dimple 8*a*, and what is indicated by reference sign Ob is the center of the dimple 8*b*. What is indicated by reference sign Ca is an intersecting point of line La passing the center Oa and extending in a radial direction of the golf ball 2 with the phantom sphere 12. What is indicated by reference sign Cb is an intersecting point of line Lb passing the center Ob and extending in a radial direction of the golf ball 2 with the phantom sphere 12. The circular arc provided by connecting the point Ca and the point Cb is referred to as a "joint arc". The joint arc is present on the surface of the phantom sphere 12. The joint arc is a part of the great circle. The joint arc does not cross other dimples 8. Herein, a dimple pair the joint arc of which does not cross other dimples 8 is referred to as an "adjacent dimple pair". The dimple 8*a* and the dimple 8*b* construct the adjacent dimple pair. The edge Ed of the dimple 8*a* is positioned on the joint arc (Ca-Cb). Also the edge Ed of the dimple 8*b* is positioned on the joint arc (Ca-Cb). The circular arc (Ed-Ed) is a part of the joint arc (Ca-Cb). The length of the circular arc (Ed-Ed) corresponds to the pitch of the adjacent dimple pair (8*a*-8*b*). When the dimple 8*a* is away from the dimple 8*b*, the value of the pitch is positive. When the dimple 8*a* is in contact with the dimple 8*b*, the value of the pitch is zero. When the dimple 8*a* crosses the dimple 8*b*, the value of the pitch is zero.

As is clear from FIG. 4, the joint arc (Ca-Cc) does not cross other dimples 8. The dimple 8*a* and the dimple 8*c* construct the adjacent dimple pair. The joint arc (Ca-Cd) does not cross other dimples 8. The dimple 8*a* and the dimple 8*d* construct the adjacent dimple pair. The joint arc (Ca-Ce) does not cross other dimples 8. The dimple 8*a* and the dimple 8*e* construct the adjacent dimple pair. The joint arc (Cb-Cc) crosses the dimple 8*d*. Thus, pair of the dimple 8*b* and the dimple 8*c* is not the adjacent dimple pair.

This golf ball 2 has 1382 adjacent dimple pairs. Among them, 914 adjacent dimple pairs have a pitch of equal to or less than (Da/4), and 546 adjacent dimple pairs have a pitch of equal to or less than (Da/20). The pitch of equal to or less than (Da/20) is extremely small in comparison with the mean diameter Da. In this golf ball 2, the ratio (N1/N) of the number N1 of the adjacent dimple pairs having a pitch of (Da/4) or less to the total number N of the dimples is 2.79. In this golf ball 2, the ratio (N2/N1) of the number N2 of the adjacent dimple pairs having a pitch of (Da/20) or less to the number N1 is 0.60.

The ratio (N1/N) is preferably equal to or greater than 2.70, and the ratio (N2/N1) is preferably equal to or greater than 0.50. In other words, it is preferred that the golf ball 2 satisfies the following formulae (I) and (II):

$$(N1/N) \geqq 2.70 \quad \text{(I)},$$

$$(N2/N1) \geqq 0.50 \quad \text{(II)}$$

In the present invention, when the numbers N1 and N2 are calculated, the pitch is compared with the mean diameter Da. According to conventional golf balls having numerous small dimples arranged in order to achieve high density, the values of (N1/N) and (N2/N1) are small. To the contrary, in the golf ball 2 which satisfies the above formulae (I) and (II), the dimples 8 are arranged in an extremely dense manner, and the number of small dimples 8 is low. In this golf ball 2, individual dimples 8 can be responsible for the dimple effect. This golf ball 2 is excellent in flight performance.

In light of flight performance, the ratio (N1/N) is preferably equal to or greater than 2.75, and particularly preferably equal to or greater than 2.90. The ratio (N1/N) is preferably equal to or less than 4.00. In light of flight performance, the ratio (N2/N1) is more preferably equal to or greater than 0.54, still more preferably equal to or greater than 0.60, and particularly preferably equal to or greater than 0.64. The ratio (N2/N1) is equal to or less than 1.00.

In light of achievement of the dimple effect of the individual dimples 8, the mean diameter Da is preferably equal to or greater than 4.00 mm, more preferably equal to or greater than 4.10 mm, and particularly preferably equal to or greater than 4.15 mm. The mean diameter Da is preferably equal to or less than 5.50 mm. By setting the mean diameter Da to be equal to or less than 5.50 mm, fundamental feature of the golf ball 2 which is substantially a sphere is not deteriorated.

Area s of the dimple 8 is an are a of a region surrounded by the contour line when the center of the golf ball 2 is viewed at infinity. In the instance of a circular dimple 8, the are a s is calculated by the following formula:

$$s=(Di/2)^2\cdot\pi$$

In the golf ball 2 shown in FIG. 2, the are a of the dimple A is 15.90 $mm^2$; the are a of the dimple B is 15.20 $mm^2$; the are a of the dimple C is 14.52 $mm^2$; the are a of the dimple D is 13.20 $mm^2$; the are a of the dimple E is 12.57 mm 2; the are a of the dimple F is 9.62 mm 2; and the are a of the dimple G is 7.07 $mm^2$.

In the present invention, ratio of total of the are as s of all the dimples 8 to the surface are a of the phantom sphere 12 is referred to as an occupation ratio. From the standpoint that sufficient dimple effect is achieved, the occupation ratio is preferably equal to or greater than 75%, more preferably equal to or greater than 78%, and particularly preferably equal to or greater than 81%. The occupation ratio is preferably equal to or less than 90%. According to the golf ball 2 shown in FIG. 2, total are a of the dimples 8 is 4500.5 $mm^2$. Because the surface are a of the phantom sphere 12 of this golf ball 2 is 5728.0 $mm^2$, the occupation ratio is 78.6%.

When the diameter Di of the dimple 8 is set to be great, the dimples 8 may cross with each other. Although apparent occupation ratio of the dimples 8 is great in the golf ball 2 having numerous crossings, the effective area of the dimples 8 shall be small. In light of the flight performance, greater effective area is more preferred as compared with the apparent occupation ratio. In other words, it is preferred that number of the crossings of the dimples 8 is smaller. Ratio (N3/N1) of number N3 of crossing adjacent dimple pairs to the number N1 is preferably equal to or less than 0.10, more preferably equal to or less than 0.08, and particularly preferably equal to or less than 0.06. Ideally, the ratio (N3/N1) is zero. In the golf ball 2 shown in FIG. 2, the number N3 is 12, and the ratio (N3/N1) is 0.013.

In light of the dimple effect, ratio (N4/N) of number N4 of the dimples 8 having a diameter of equal to or less than 3.50 mm to the total number N is preferably equal to or less than 0.20, more preferably equal to or less than 0.15, and particularly preferably equal to or less than 0.10. Ideally, the ratio (N4/N) is zero.

From the standpoint that sufficient occupation ratio can be achieved, total number of the dimples 8 is preferably equal to or greater than 200, and particularly preferably equal to or greater than 252. From the standpoint that individual dimples 8 can have a sufficient diameter, it is preferred that the total number is equal to or less than 362, further equal to or less than 360, still more equal to or less than 332, and yet more equal to or less than 328.

It is preferred that multiple types of the dimples 8 having a different diameter one another are arranged. By thus arranging multiple types of the dimples 8, great ratio (N1/N), great ratio (N2/N1), great mean diameter Da, and small ratio (N3/N1) of the golf ball 2 can be achieved. In this respect, number of the types of the dimples 8 is more preferably equal to or greater than 3, and particularly preferably equal to or greater than 4. In light of ease in manufacture of the mold, the number of the types is preferably equal to or less than 15.

According to the present invention, the term "dimple volume" means a volume of a part surrounded by a plane that includes the contour of the dimple 8, and the surface of the dimple 8. In light of possible suppression of hopping of the golf ball 2, total volume of the dimples 8 is preferably equal to or greater than 250 $mm^3$, more preferably equal to or greater than 260 $mm^3$, and particularly preferably equal to or greater than 270 $mm^3$. In light of possible suppression of dropping of the golf ball 2, the total volume is preferably equal to or less than 400 $mm^3$, more preferably equal to or less than 390 $mm^3$, and particularly preferably equal to or less than 380 $mm^3$.

In light of possible suppression of hopping of the golf ball 2, the depth of the dimple 8 is preferably equal to or greater than 0.05 mm, more preferably equal to or greater than 0.08 mm, and particularly preferably equal to or greater than 0.10 mm. In light of possible suppression of dropping of the golf ball 2, the depth is preferably equal to or less than 0.60 mm, more preferably equal to or less than 0.45 mm, and particularly preferably equal to or less than 0.40 mm. The depth is a distance between the tangent line T and the deepest point of the dimple 8.

In the present invention, the great circle that is situated on the phantom sphere 12 and that does not cross the dimple 8 is referred to as a "great circle band". When the rotation axis of the back spin is orthogonal to a plane including the great circle band, circumferential rate of the back spin becomes greatest on this great circle band. When the rotation axis of the back spin is orthogonal to a plane including the great circle band, sufficient dimple effect may not be achieved. The great circle band interferes the flight performance. Further, the great circle band also interferes the aerodynamic symmetry. It is preferred that the golf ball 2 does not have any great circle band.

In FIG. 2, two pole points P, two first latitude lines 14, two second latitude lines 16 and an equatorial line 18 are depicted. Latitude of the pole point P is 90°, and latitude of the equatorial line 18 is 0°. Latitude of the first latitude line 14 is greater than that of the second latitude line 16.

This golf ball 2 has a northern hemisphere N above the equatorial line 18, and a southern hemisphere S below the equatorial line 18. Each of the northern hemisphere N and the southern hemisphere S has a pole vicinity region 20, an equator vicinity region 22 and a coordination region 24. The first latitude line 14 is a boundary line between the pole vicinity region 20 and the coordination region 24. The second latitude line 16 is a boundary line between the equator vicinity region 22 and the coordination region 24. The pole vicinity region 20 is located between the pole point P and the first latitude line 14. The equator vicinity region 22 is located between the second latitude line 16 and the equatorial line 18. The coordination region 24 is located between the first latitude line 14 and the second latitude line 16. In other words, the coordination region 24 is located between the pole vicinity region 20 and the equator vicinity region 22.

With respect to the dimple 8 crossing over the first latitude line 14 or the second latitude line 16, the region to which it belongs is decided on the basis of the center position thereof. The dimple 8 which crosses over the first latitude line 14 and which has the center positioned in the pole vicinity region 20 belongs to the pole vicinity region 20. The dimple 8 which crosses over the first latitude line 14 and which has the center positioned in the coordination region 24 belongs to the coordination region 24. The dimple 8 which crosses over the second latitude line 16 and which has the center positioned in the equator vicinity region 22 belongs to the equator vicinity region 22. The dimple 8 which crosses over the second latitude line 16 and which has the center positioned in the coordination region 24 belongs to the coordination region 24.

Figure 6:
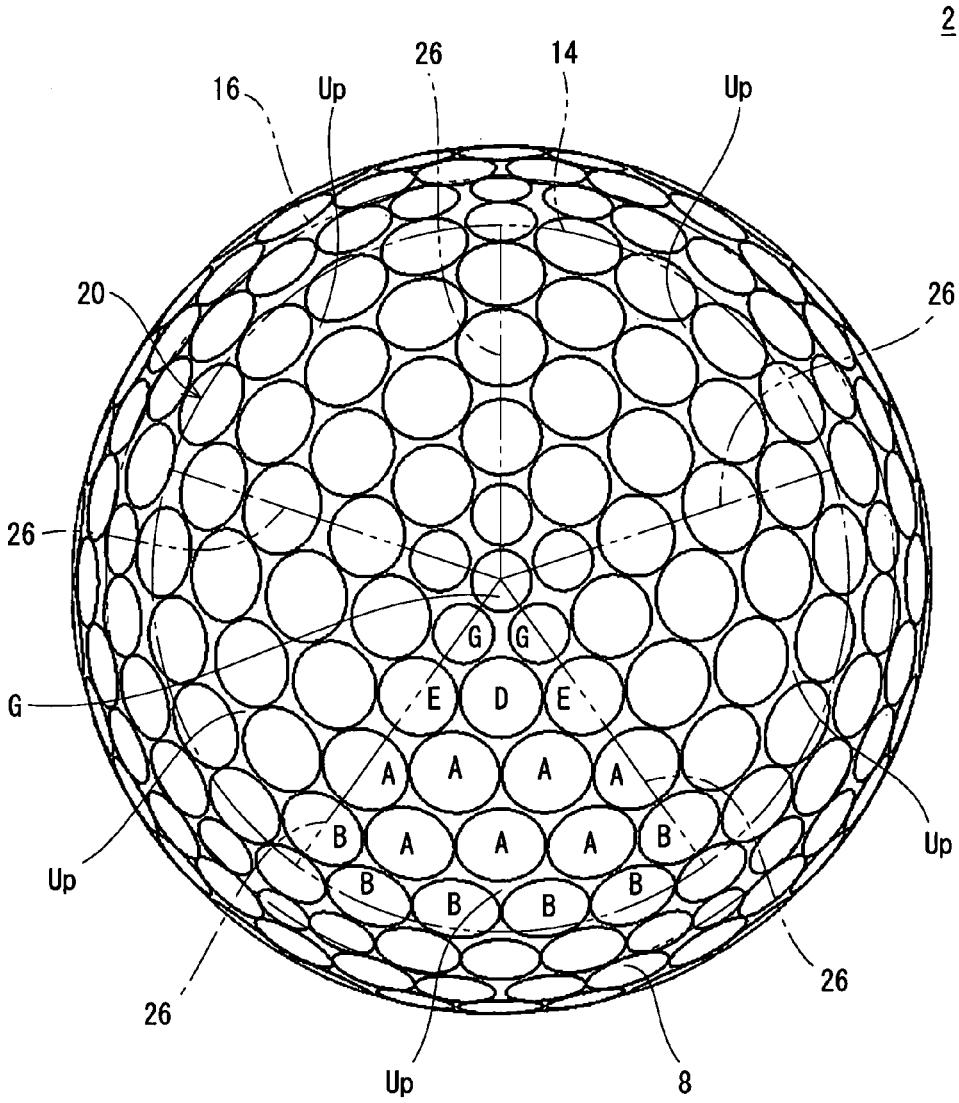
FIG. 6 shows a plan view illustrating the golf ball shown in FIG. 2.
Figure 7:
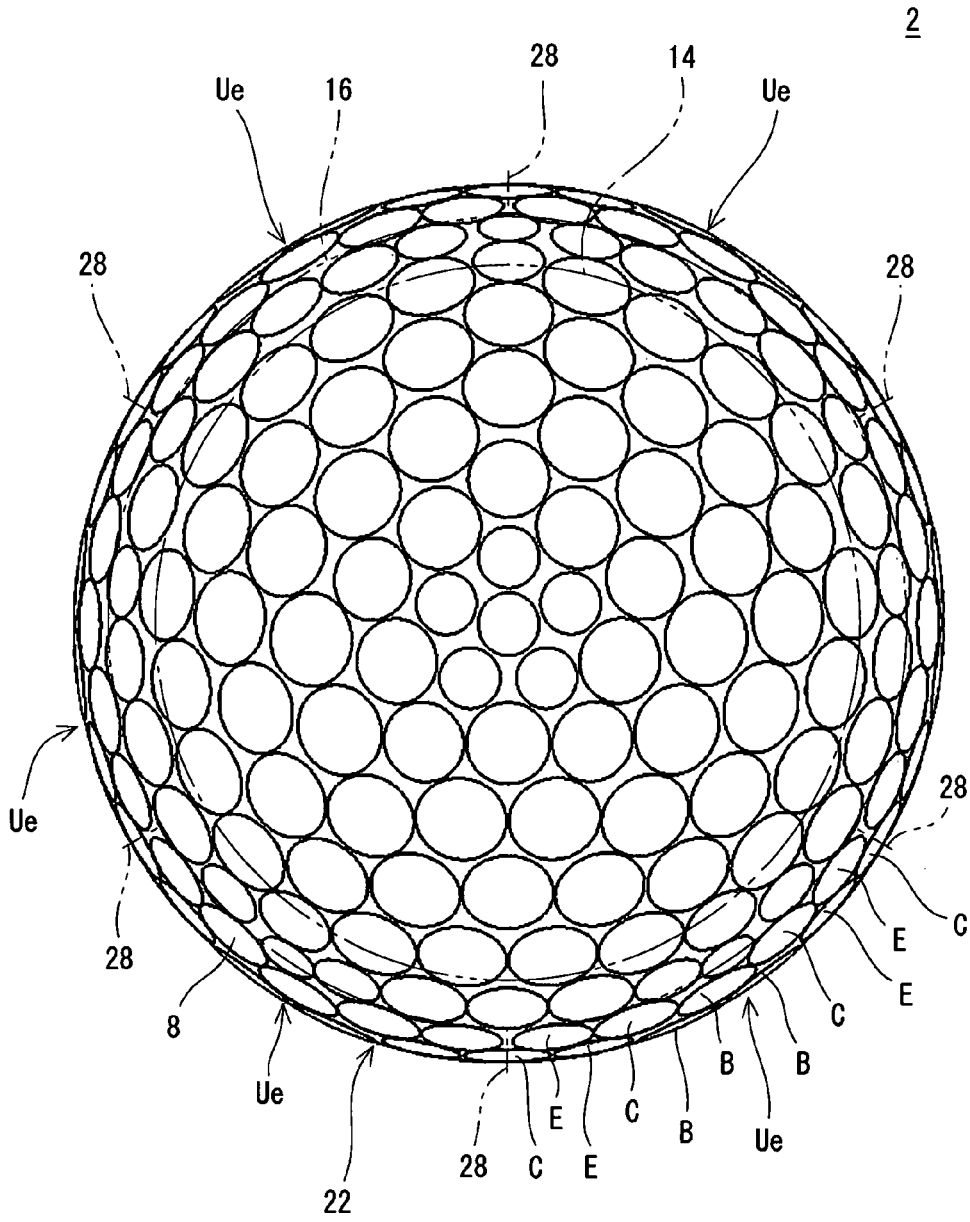
FIG. 7 shows a plan view illustrating the golf ball shown in FIG. 2.
Figure 8:
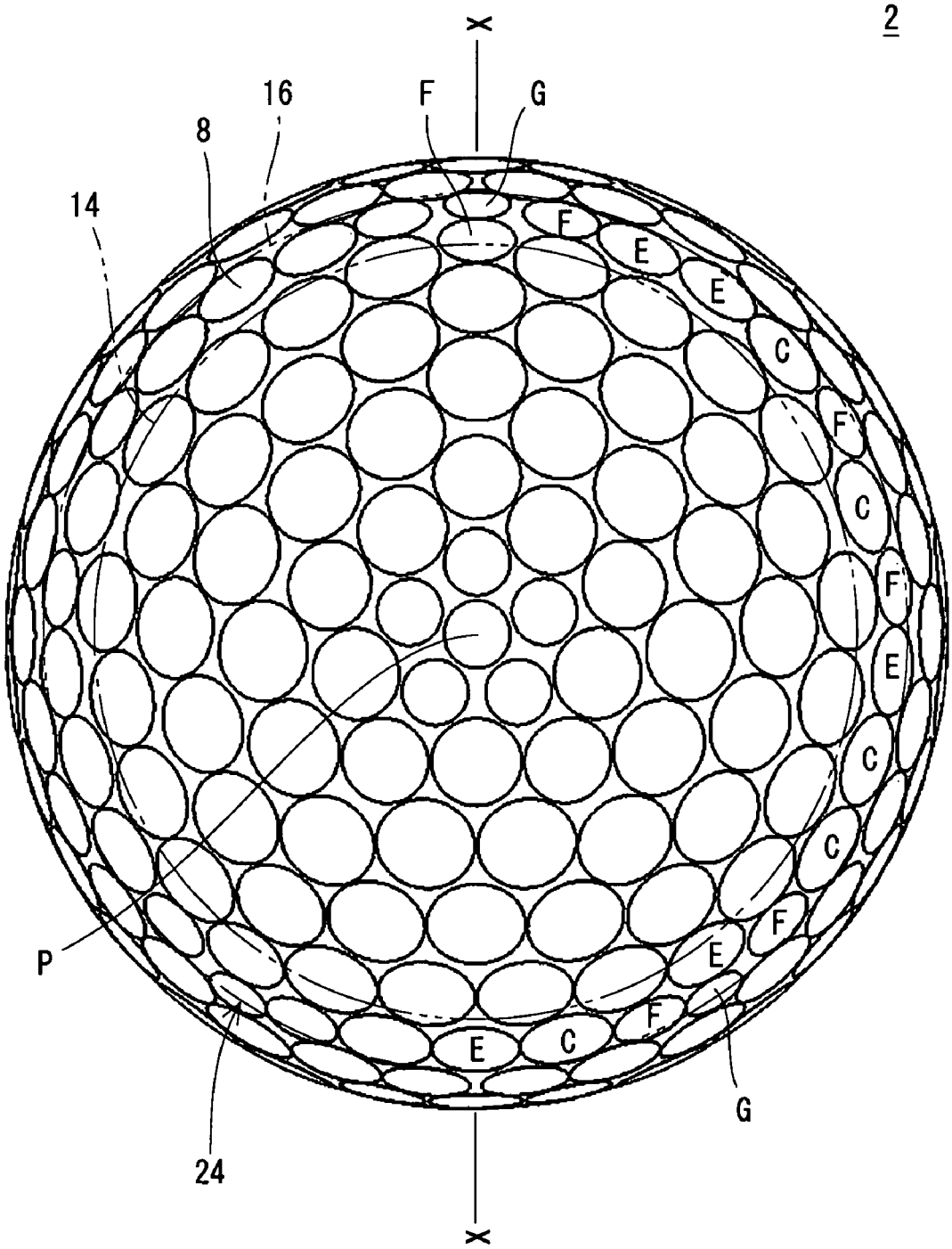
FIG. 8 shows a plan view illustrating the golf ball shown in FIG. 2.

FIGS. 6, 7 and 8 show a plan view illustrating the golf ball 2 shown in FIG. 2. FIG. 6 shows five first meridian lines 26 together with the first latitude line 14 and the second latitude line 16. In this FIG. 6, the region surrounded by the first latitude line 14 is the pole vicinity region 20. The pole vicinity region 20 can be comparted into five units Up. The unit Up has a spherical triangular shape. The contour of the unit Up consists of a part of the first latitude line 14, and two first meridian lines 26. In FIG. 6, types of the dimples 8 are shown by the reference signs A, B, D, E and G with respect to one unit Up.

The dimple pattern in five units Up has rotational symmetries through 72°. In other words, when the dimple pattern in one unit Up is rotated 72° in a meridian direction around the pole point P as a center, it substantially overlaps with the dimple pattern in the adjacent unit Up. Herein, the states of "substantially overlapping" include not only the states in which the dimple 8 in one unit completely coincides with the corresponding dimple 8 in another unit, but also the states in which the dimple 8 in one unit is deviated to some extent from the corresponding dimple 8 in another unit. Herein, the states of "deviated to some extent" include the states in which the center of the dimple 8 in one unit deviates to some extent from the center of the corresponding dimple 8 in another unit. The distance between the center of the dimple 8 in one unit and the center of the corresponding dimple 8 in another unit is preferably equal to or less than 1.0 mm, and more preferably equal to or less than 0.5 mm. Herein, the states of "deviated to some extent" include the states in which the dimension of the dimple 8 in one unit is different to some extent from the dimension of the corresponding dimple 8 in another unit. The difference in dimension is preferably equal to or less than 0.5 mm, and more preferably equal to or less than 0.3 mm. The dimension means the length of the longest line segment which can be depicted over the contour of the dimple 8. In the case of a circular dimple 8, the dimension is identical with the diameter of the same.

FIG. 7 shows six second meridian lines 28 together with the first latitude line 14 and the second latitude line 16. In this FIG. 7, the external side of the second latitude line 16 corresponds to the equator vicinity region 22. The equator vicinity region 22 can be comparted into six units Ue. The unit Ue has a spherical trapezoidal shape. The contour of the unit Ue consists of a part of the second latitude line 16, two second meridian lines 28 and a part of the equatorial line 18 (see, FIG. 2). In FIG. 7, types of the dimples 8 are shown by the reference signs B, C and E with respect to one unit Ue.

The dimple pattern in six units Ue has rotational symmetries through 60°. In other words, when the dimple pattern in one unit Ue is rotated 60° in a meridian direction around the pole point P as a center, it substantially overlaps with the dimple pattern in the adjacent unit Ue. The dimple pattern in the equator vicinity region 22 can be also comparted into three units. In this instance, the dimple pattern in each unit has rotational symmetries through 120°. The dimple pattern in the equator vicinity region 22 can be also comparted into two units. In this instance, the dimple pattern in each unit has rotational symmetries through 180°. The dimple pattern in the equator vicinity region 22 has three rotation symmetry angles (i.e. 60°, 120° and 180°). In the region having multiple rotation symmetry angles, the unit Ue is decided by the compartment on the basis of the smallest rotation symmetry angle (in this case, 60°).

FIG. 8 shows the first latitude line 14 and the second latitude line 16. In this FIG. 8, the region surrounded by the first latitude line 14 and the second latitude line 16 is the coordination region 24. In FIG. 8, with respect to the dimples 8 provided in the coordination region 24, types thereof are shown by the reference signs C, E, F and G.

The dimple pattern in the coordination region 24 has a line symmetry with respect to a line X-X in a plan view. This dimple pattern does not have any axis of symmetry other than the line X-X. Rotation of 0° or greater and less than 360° around the pole point P as a center does not generate any overlap of the dimple patterns with one another. In other words, the dimple pattern in the coordination region 24 cannot be comparted into multiple units that are rotationally symmetric to each other.

The dimple pattern in the coordination region 24 which can be comparted into multiple units that are rotationally symmetric is also acceptable. In this instance, number of the units in the coordination region 24 must be different from the number of the units Up in the pole vicinity region 20, and further, must be also different from the number of the units Ue in the equator vicinity region 22.

In this golf ball 2, number Np of the units Up in the pole vicinity region 20 is 5, while number Ne of the units Ue in the equator vicinity region 22 is 6. These numbers are different from each other. The dimple pattern with the number Np and the number Ne being different from each other has great variety. According to this golf ball 2, air flow during the flight is efficiently disturbed. This golf ball 2 is excellent in the flight performance. Combination (Np, Ne) of the number Np and the number Ne is not limited to (5, 6). Illustrative examples of other combination include (2, 3), (2, 4), (2, 5), (2, 6), (3, 2), (3, 4), (3, 5), (3, 6), (4, 2), (4, 3), (4, 5), (4, 6), (5, 2), (5, 3), (5, 4), (6, 2), (6, 3), (6, 4) and (6, 5).

Although detailed grounds are unknown, greater dimple effect can be achieved when one of the number Np and the number Ne is an odd number, and another is an even number, according to findings attained by the present inventors. In addition, particularly great dimple effect can be achieved when the difference between the number Np and the number Ne is 1. Illustrative examples of the combination involving this difference of 1 include (2, 3), (3, 2), (3, 4), (4, 3), (4, 5), (5, 4), (5, 6) and (6, 5).

In light of the dimple effect, it is preferred that the pole vicinity region 20 has a sufficient are a, and that the equator vicinity region 22 also has a sufficient are a. In light of the are a of the equator vicinity region 22, latitude of the first latitude line 14 and the second latitude line 16 is preferably equal to or greater than 15°, and more preferably equal to or greater than 20°. In light of the are a of the pole vicinity region 20, latitude of the first latitude line 14 and the second latitude line 16 is preferably equal to or less than 45°, and more preferably equal to or less than 40°. The first latitude line 14 can be arbitrarily selected from innumerable latitude lines. The second latitude line 16 can be also selected arbitrarily from innumerable latitude lines. In the golf ball 2 shown in FIGS. 2 and 6 to 8, the latitude of the first latitude line 14 is 42°, and the latitude of the second latitude line 16 is 30°.

In light of contribution of the pole vicinity region 20 to the dimple effect, a proportion of the number of the dimples 8 that exist in the pole vicinity region 20 to the total number of the dimples 8 is preferably equal to or greater than 20%, and more preferably equal to or greater than 25%. This proportion is preferably equal to or less than 45%.

In light of contribution of the equator vicinity region 22 to the dimple effect, a proportion of the number of the dimples 8 that exist in the equator vicinity region 22 to total number of the dimples 8 is preferably equal to or greater than 30%, and more preferably equal to or greater than 35%. This proportion is preferably equal to or less than 65%.

Provided that the pole vicinity region 20 is adjacent to the equator vicinity region 22 across the boundary line, the dimples 8 cannot be arranged densely in the vicinity of this boundary line resulting from the difference in the numbers of the units. In this case, large land 10 shall be present in the vicinity of the boundary line. The large land 10 inhibits the dimple effect. In the golf ball 2 according to the present invention, the coordination region 24 is present between the pole vicinity region 20 and the equator vicinity region 22. In this coordination region 24, the dimples 8 can be arranged without being bound by the number of the units. Thus, the are a of the land 10 can be diminished. Owing to this coordination region 24, high occupation ratio is achieved.

In light of the occupation ratio, it is preferred that the coordination region 24 has a sufficient are a. In this respect, the difference between the latitude of the first latitude line 14 and the latitude of the second latitude line 16 is preferably equal to or greater than 4°. When the coordination region 24 is too large, the dimple effect resulting from the difference between the number Np and the number Ne may be deteriorated. In light of the dimple effect, the difference between the latitude of the first latitude line 14 and the latitude of the second latitude line 16 is preferably equal to or less than 20°, and more preferably equal to or less than 15°.

In light of the occupation ratio, a proportion of the number of the dimples 8 that exist in the coordination region 24 to the total number of the dimples 8 is preferably equal to or greater than 5%, and more preferably equal to or greater than 8%. In light of the dimple effect resulting from the difference between the number Np and the number Ne, this proportion is preferably equal to or less than 24%, more preferably equal to or less than 22%, and particularly preferably equal to or less than 20%.

According to the golf ball 2 in which the pole vicinity region 20 is comparted into the units Up, and further the equator vicinity region 22 is comparted into the units Ue, period of the pattern is generated by rotation. As the number Np of the units Up and the number Ne of the units Ue are larger, the period becomes shorter. To the contrary, as the number Np and the number Ne are smaller, the period becomes longer. Adequate period may improve the dimple effect. In light of the adequate period, the number Np and the number Ne are preferably 4 or greater and 6 or less, and particularly preferably 5 or greater and 6 or less. Most preferable combination of the number Np and the number Ne (Np, Ne) is (5, 6) and (6, 5). In the golf ball 2 shown in FIG. 2 and FIGS. 6 to 8, (Np, Ne) is (5, 6).

In light of the aerodynamic symmetry, it is preferred that the dimple pattern in the northern hemisphere N is equivalent to the dimple pattern in the southern hemisphere S. When a pattern that is symmetric to the dimple pattern in the northern hemisphere N with respect to the plane that includes the equatorial line 18 substantially overlaps with the dimple pattern in the southern hemisphere S, these patterns are decided to be equivalent. Also, when the pattern that is symmetric to the dimple pattern in the northern hemisphere N with respect to the plane that includes the equatorial line 18 substantially overlaps with the dimple pattern in the southern hemisphere S upon rotation thereof around the pole point P as a center, these patterns are decided to be equivalent.

According to the present invention, size of each site of the dimple 8 is measured on the golf ball 2 having a paint layer.

Figure 9:
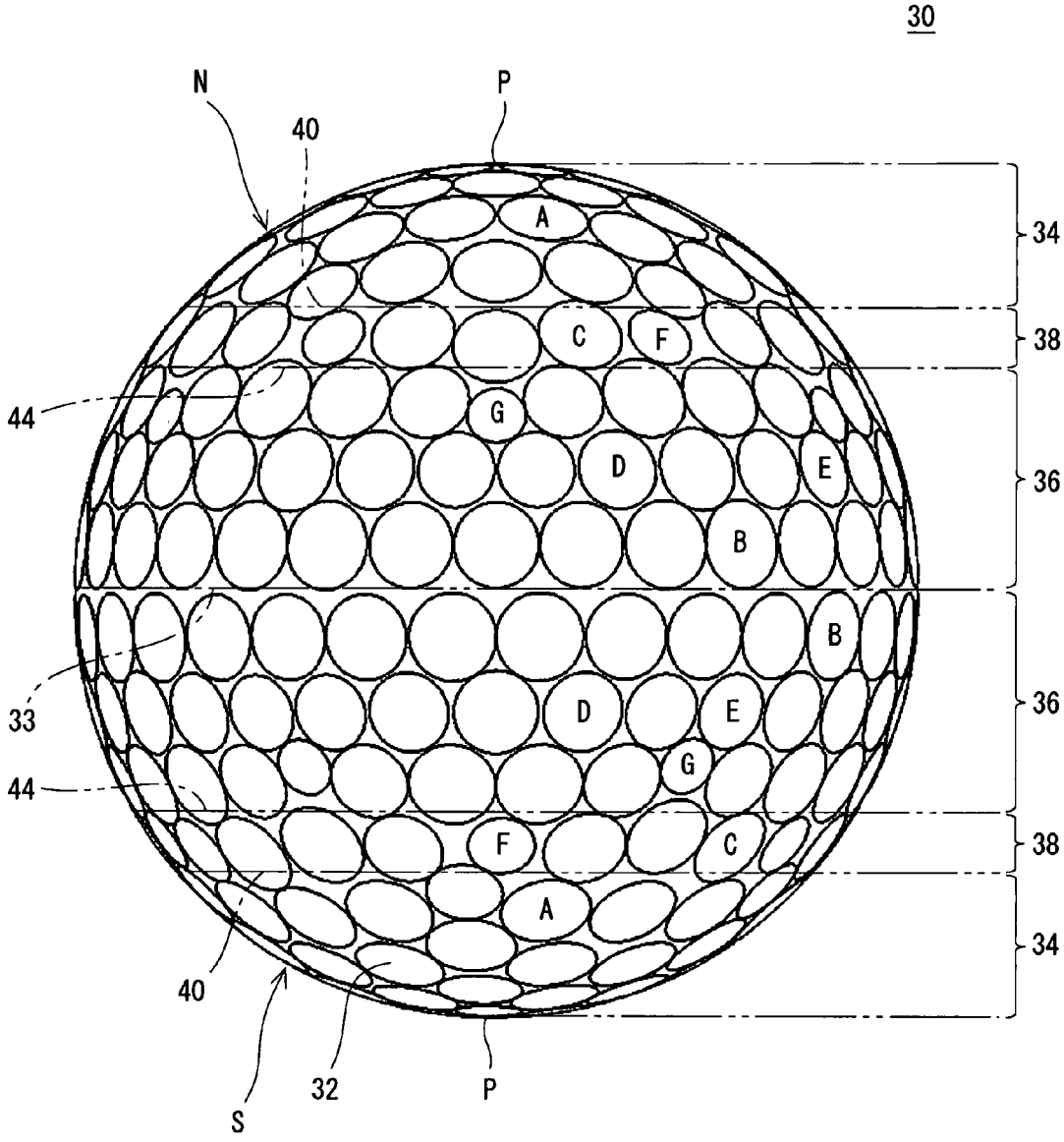
FIG. 9 shows a front view illustrating a golf ball according to another embodiment of the present invention.

FIG. 9 shows a front view illustrating a golf ball 30 according to another embodiment of the present invention. In FIG. 9, types of the dimples 32 are indicated by the reference signs A to G. All dimples 32 have a plane shape of circular. This golf ball 30 has dimples A having a diameter of 4.60 mm, dimples B having a diameter of 4.45 mm, dimples C having a diameter of 4.30 mm, dimples D having a diameter of 4.10 mm, dimples E having a diameter of 3.90 mm, dimples F having a diameter of 3.40 mm, and dimples G having a diameter of 3.00 mm. Number of the dimples A is 80; number of the dimples B is 60; number of the dimples C is 62; number of the dimples D is 58; number of the dimples E is 38; number of the dimples F is 18; and number of the dimples G is 14. Total number of the dimples 32 is 330.

This golf ball 30 has 1476 adjacent dimple pairs. Among them, 964 adjacent dimple pairs have a pitch of equal to or less than (Da/4), and 614 adjacent dimple pairs have a pitch of equal to or less than (Da/20). The ratio (N1/N) of the number N1 of the adjacent dimple pairs having a pitch of (Da/4) or less to the total number N of the dimples is 2.92. The ratio (N2/N1) of the number N2 of the adjacent dimple pairs having a pitch of (Da/20) or less to the number N1 is 0.64. In the golf ball 30, the dimples 32 are arranged in an extremely dense manner, and the number of small dimples 32 is low. In this golf ball 30, individual dimples 32 can be responsible for the dimple effect. This golf ball 30 is excellent in flight performance.

This golf ball 30 has a mean diameter Da of 4.21 mm, and an occupation ratio of 81.1%. This golf ball 30 has seven types of the dimples 32. According to this golf ball 30, the number N3 of the crossing adjacent dimple pairs is 58, and the ratio (N3/N1) is 0.060. According to this golf ball 30, the ratio (N4/N) of the number N4 of the dimples 32 having a diameter of equal to or less than 3.50 mm to the total number N is 0.10. According to this golf ball 30, great ratio (N1/N), great ratio (N2/N1), great mean diameter Da, small ratio (N3/N1), and small ratio (N4/N) are achieved. This golf ball 30 is excellent in flight performance.

As shown in FIG. 9, this golf ball 30 has an equatorial line 33, a northern hemisphere N and a southern hemisphere S. The equatorial line 33 is a great circle band. Each of the northern hemisphere N and the southern hemisphere S has a pole vicinity region 34, an equator vicinity region 36 and a coordination region 38.

Figure 10:
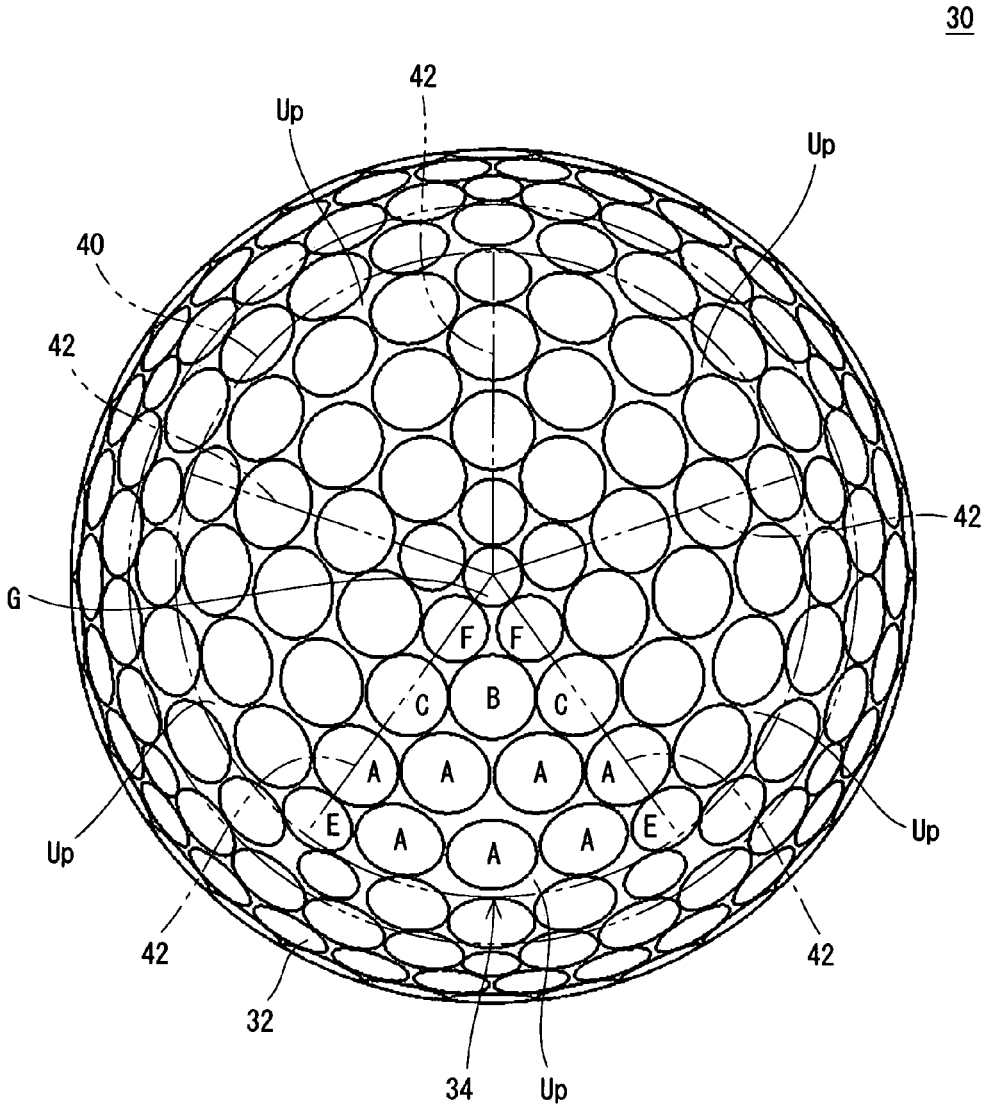
FIG. 10 shows a plan view illustrating the golf ball shown in FIG. 9.
Figure 11:
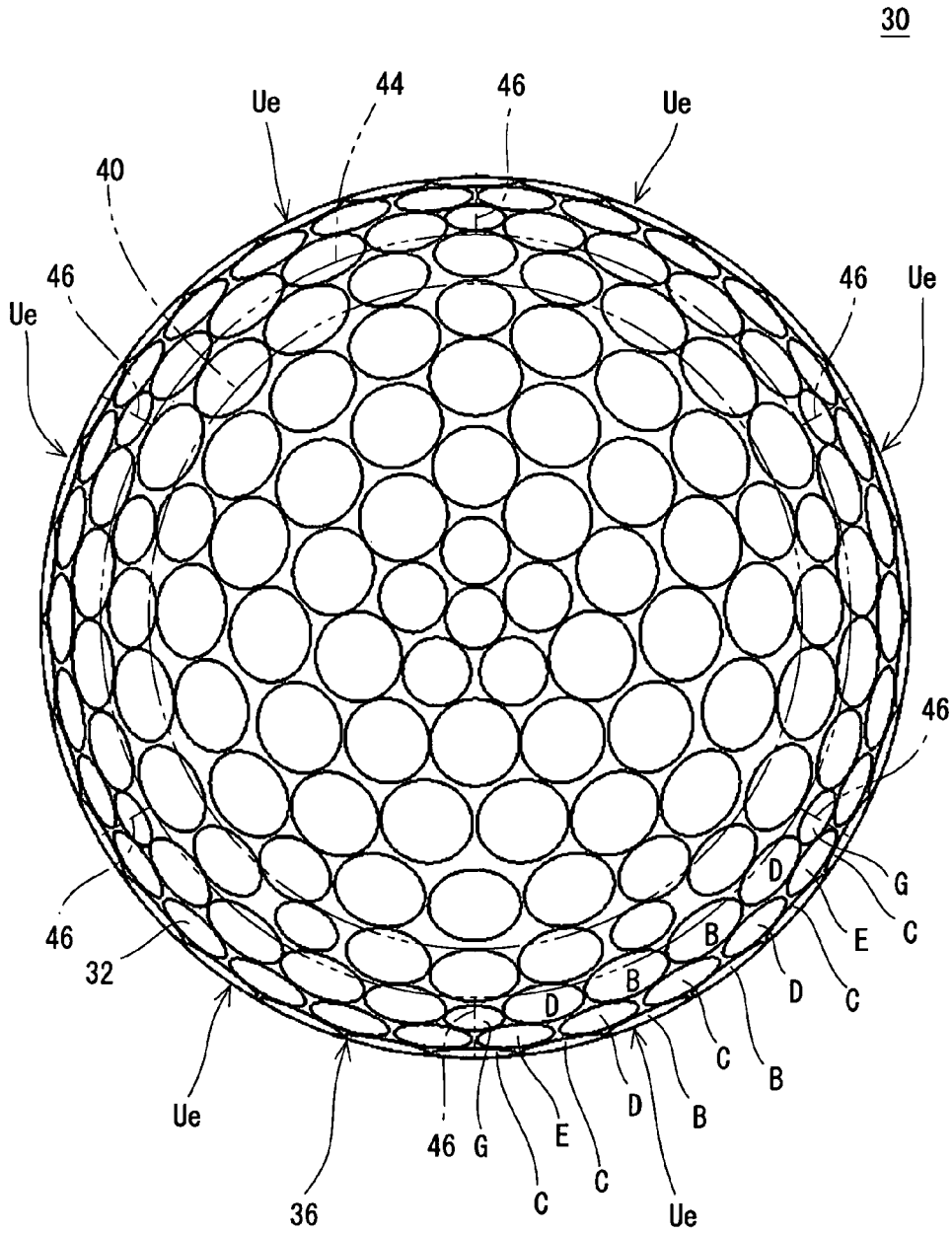
FIG. 11 shows a plan view illustrating the golf ball shown in FIG. 9.
Figure 12:
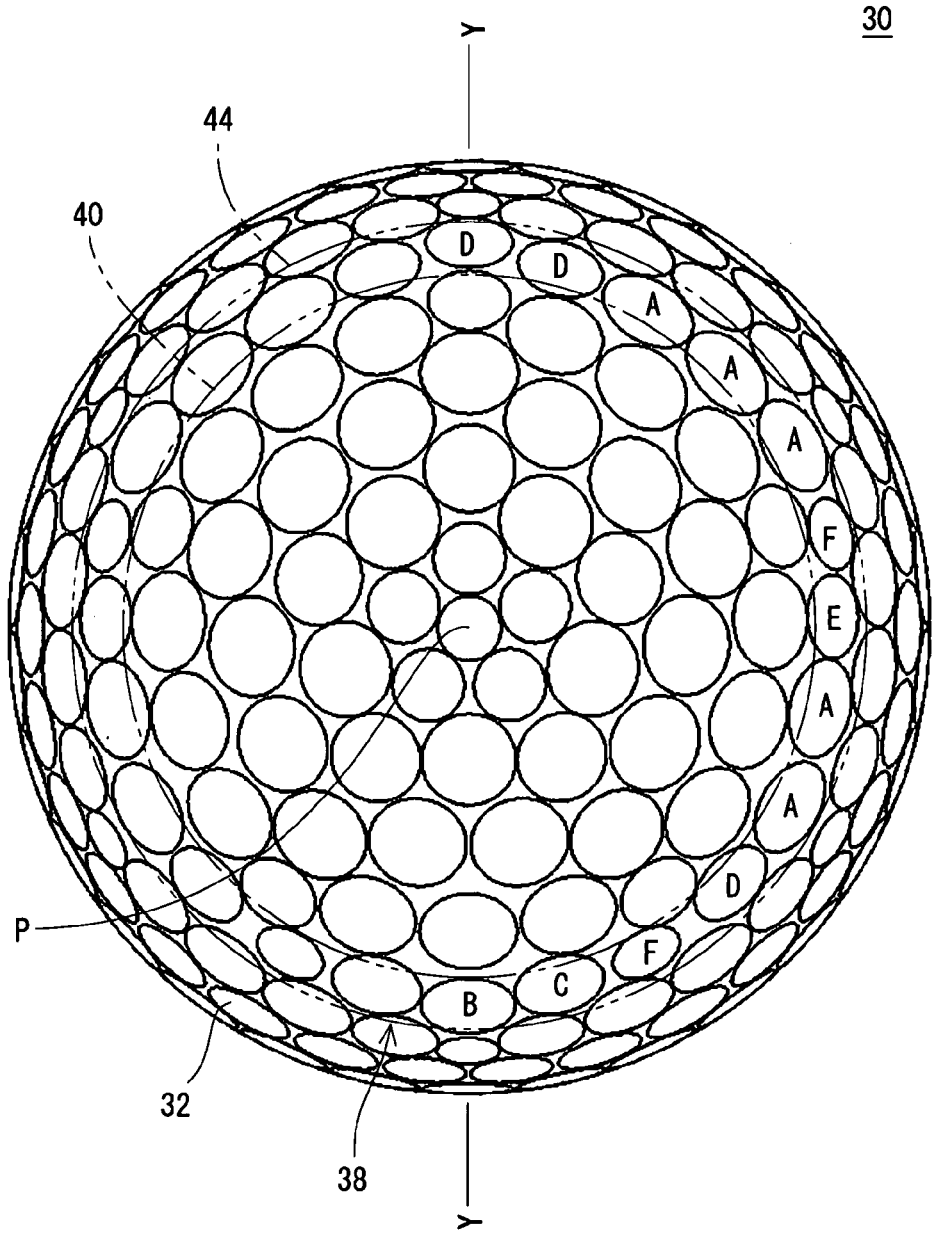
FIG. 12 shows a plan view illustrating the golf ball shown in FIG. 9.

FIGS. 10, 11 and 12 show a plan view illustrating the golf ball 30 shown in FIG. 9. In FIG. 10, the region surrounded by the first latitude line 40 is a pole vicinity region 34. The pole vicinity region 34 can be comparted into five units Up. The unit Up has a spherical triangular shape. The contour of the unit Up consists of a part of the first latitude line 40, and two first meridian lines 42. In FIG. 10, types of the dimples 32 are shown by the reference signs A, B, C, E and G with respect to one unit Up. The dimple pattern in five units Up has rotational symmetries through 72°.

In FIG. 11, the external side of the second latitude line 44 corresponds to the equator vicinity region 36. The equator vicinity region 36 can be comparted into six units Ue. The unit Ue has a spherical trapezoidal shape. The contour of the unit Ue consists of a part of the second latitude line 44, two second meridian lines 46 and a part of the equatorial line 33 (see, FIG. 9). In FIG. 11, types of the dimples 32 are shown by the reference signs B, C, D, E and G with respect to one unit Ue. The dimple pattern in six units Ue has rotational symmetries through 60°.

In FIG. 12, the region surrounded by the first latitude line 40 and the second latitude line 44 is the coordination region 38. In FIG. 12, with respect to the dimples 32 provided in the coordination region 38, types thereof are shown by the reference signs A, B, C, D, E and F. The dimple pattern in the coordination region 38 has a line symmetry with respect to a line Y-Y in a plan view. This dimple pattern does not have any axis of symmetry other than the line Y-Y. Rotation of 0° or greater and less than 360° around the pole point P as a center does not generate overlap of the dimple patterns with one another. In other words, the dimple pattern in the coordination region 38 cannot be comparted into multiple units that are rotationally symmetric to each other.

In the golf ball 30 shown in FIGS. 9 to 12, the latitude of the first latitude line 40 is 35°, and the latitude of the second latitude line 44 is 21°.

In this golf ball 30, the number Np of the units Up in the pole vicinity region 34 is 5, while the number Ne of the units Ue in the equator vicinity region 36 is 6. This dimple pattern has great variety. According to this golf ball 30, the coordination region 38 is responsible for a great occupation ratio. This golf ball 30 is excellent in the flight performance.

Figure 13:
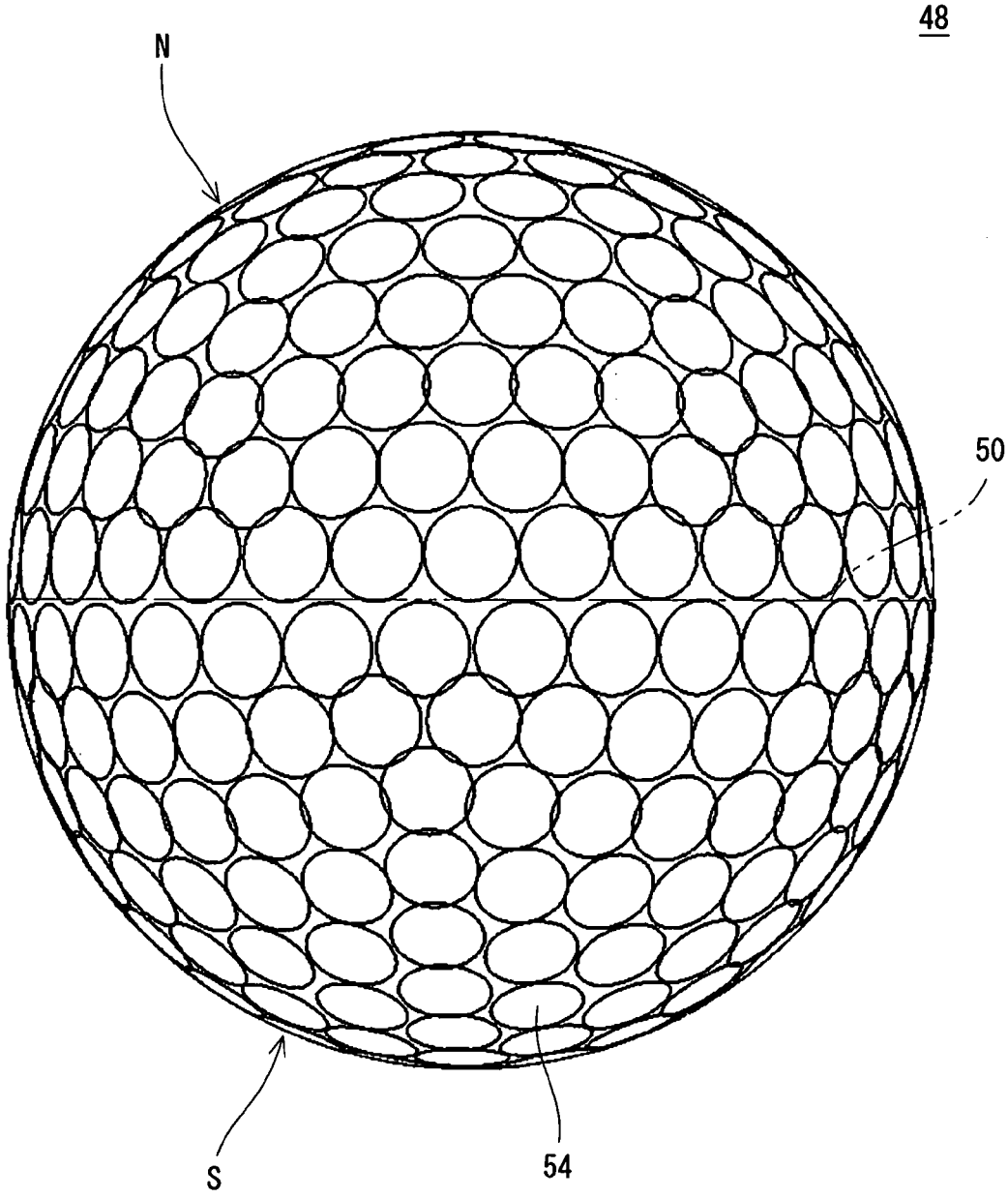
FIG. 13 shows a front view illustrating a golf ball according to still another embodiment of the present invention.
Figure 14:
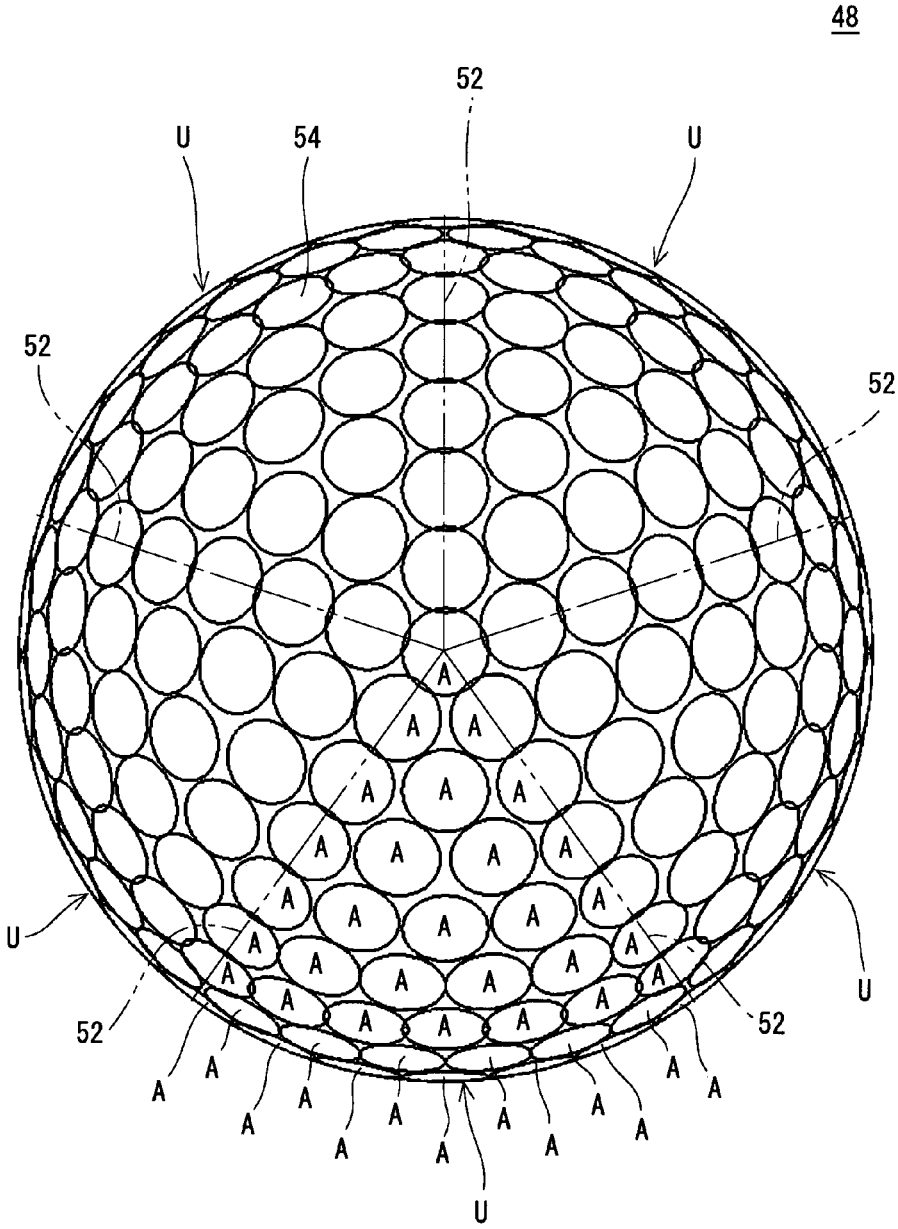
FIG. 14 shows a plan view illustrating the golf ball shown in FIG. 13.

FIG. 13 shows a front view illustrating a golf ball 48 according to still another embodiment of the present invention, and FIG. 14 shows a plan view of the same. As shown in FIG. 13, this golf ball 48 has an equatorial line 50, a northern hemisphere N and a southern hemisphere S. As shown in FIG. 14, each of the northern hemisphere N and the southern hemisphere S can be comparted into 5 units U. The unit U has a spherical triangular shape. The contour of the unit U consists of two meridian lines 52, and apart of the equatorial line 50 (see, FIG. 13). In FIG. 14, types of the dimples 54 are shown by the reference sign A with respect to one unit U. The dimple A has a diameter of 4.318 mm. Total number N of the dimples 54 is 332. The dimple pattern in five units U has rotational symmetries through 72°.

This golf ball 48 has 1450 adjacent dimple pairs. Among them, 990 adjacent dimple pairs have a pitch of equal to or less than (Da/4), and 540 adjacent dimple pairs have a pitch of equal to or less than (Da/20). The ratio (N1/N) of the number N1 of the adjacent dimple pairs having a pitch of (Da/4) or less to the total number N of the dimples is 2.98. The ratio (N2/N1) of the number N2 of the adjacent dimple pairs having a pitch of (Da/20) or less to the number N1 is 0.55. In the golf ball 48, the dimples 54 are arranged in an extremely dense manner, and the number of small dimples 54 is low. In this golf ball 48, individual dimples 54 can be responsible for the dimple effect. This golf ball 48 is excellent in flight performance.

This golf ball 48 has a mean diameter Da of 4.318 mm, and an occupation ratio of 84.9%. According to this golf ball 48, the ratio (N4/N) of the number N4 of the dimples 54 having a diameter of equal to or less than 3.50 mm to the total number N is zero. According to this golf ball 48, great ratio (N1/N), great ratio (N2/N1), great mean diameter Da, and small ratio (N4/N) are achieved.

According to this golf ball 48, the number N3 of the crossing adjacent dimple pairs is 260, and the ratio (N3/N1) is 0.263. This ratio (N3/N1) is great. According to this golf ball 48, the effective are a is small as compared with the apparent occupation ratio. Small effective are a is disadvantageous in light of the dimple effect. As is clear from FIG. 13, the equatorial line 50 does not cross the dimple 54. This equatorial line 54 corresponds to the great circle band. This golf ball 48 has one great circle band. The presence of the great circle band is disadvantageous in light of the dimple effect.

Figure 15:
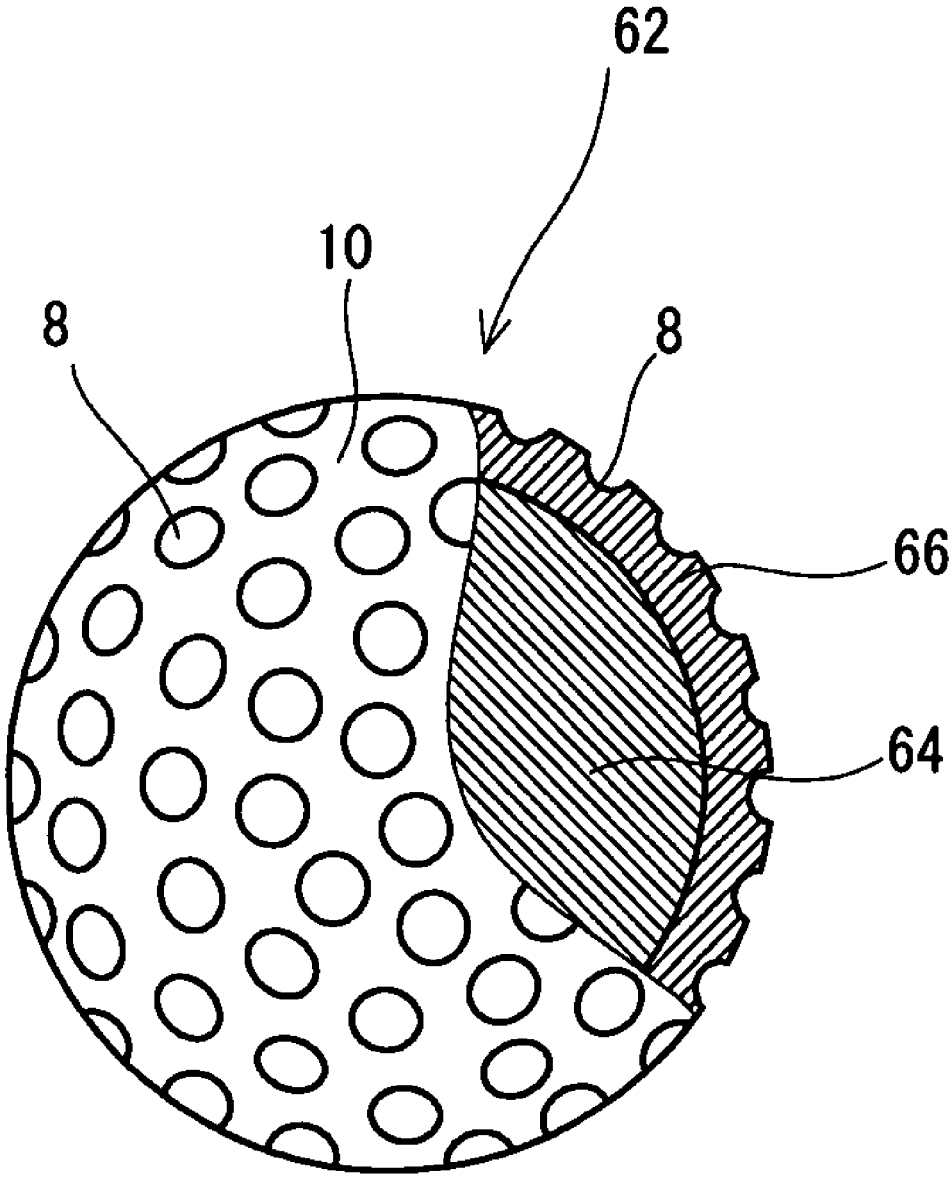
FIG. 15 shows a schematic cross-sectional view illustrating a golf ball according to still another embodiment of the present invention.

FIG. 15 shows a schematic cross-sectional view illustrating a golf ball 62 according to still another embodiment of the present invention. This golf ball 62 has a spherical core 64 and a cover 66 covering this core 64. This cover 66 consists of a single layer. In the present invention, a layer positioned at the most outside in the cover is referred to as an "outer cover". The cover 66 shown in FIG. 15 corresponds to the outer cover. This golf ball 62 does not have an inner cover. Numerous dimples 8 are formed on the surface of the cover 66. Of the surface of the golf ball 62, a part except for the dimples 8 is a land 10. This golf ball 62 has a paint layer and a mark layer to the external side of the cover 66, although these layers are not shown in the Figure. The diameter and the weight of this golf ball 62 is equivalent to those of the golf ball 2 shown in FIG. 1.

The core 64 is formed by crosslinking a rubber compound. A rubber compound which is equivalent to the rubber compound used for the core 4 shown in FIG. 1 can be used for the core 64.

The core 64 has a central hardness H1 of preferably 50 or greater and 75 or less. By the core 64 having the central hardness H1 of equal to or greater than 50, excellent resilience performance can be achieved. In this respect, the central hardness H1 is more preferably equal to or greater than 55, and particularly preferably equal to or greater than 60. The core 64 having the central hardness H1 of equal to or less than 75 suppresses spin of the golf ball 62. By the suppression of the spin, great flight distance can be achieved. In this respect, the central hardness H1 is particularly preferably equal to or less than 70. The central hardness H1 is measured by pressing a JIS-C type spring hardness scale on a central point of a hemisphere obtained by cutting the golf ball 62. For the measurement, an automated rubber hardness tester (trade name "P1", available from Koubunshi Keiki Co., Ltd.) which is equipped with this hardness scale is used.

The core 64 has a surface hardness H2 of preferably 65 or greater and 90 or less. By the core 64 having the surface hardness H2 of equal to or greater than 65, excellent resilience performance can be achieved. In this respect, the surface hardness H2 is more preferably equal to or greater than 70, and particularly preferably equal to or greater than 75. By the core 64 having the surface hardness H2 of equal to or less than 90, excellent feel at impact can be achieved. In this respect, the surface hardness H2 is more preferably equal to or less than 85. The surface hardness H2 is measured by pressing the JIS-C type spring hardness scale against the surface of the core 64. For the measurement, the automated rubber hardness tester (trade name "P1", available from Koubunshi Keiki Co., Ltd.) which is equipped with this hardness scale is used.

A difference (H2−H1) between the surface hardness H2 and the central hardness H1 is preferably 10 or greater and 25 or less. The core 64 having the difference (H2−H1) of equal to or greater than 10 is sufficiently deformed on a driver shot. In this respect, the difference (H2−H1) is more preferably equal to or greater than 12, and particularly preferably equal to or greater than 14. By the core 64 having the difference (H2−H1) of equal to or less than 25, excellent resilience performance can be achieved. In this respect, the difference (H2−H1) is more preferably equal to or less than 20, and particularly preferably equal to or less than 18.

The amount of compressive deformation of the core 64 is preferably 2.0 mm or greater and 4.5 mm or less. By the core 64 having the amount of compressive deformation of equal to or greater than 2.0 mm, low spin rate and excellent feel at impact can be achieved. In this respect, the amount of compressive deformation is particularly preferably equal to or greater than 2.5 mm. Owing to the core 64 having the amount of compressive deformation of equal to or less than 4.5 mm, excellent resilience performance can be achieved. In this respect, the amount of compressive deformation is more preferably equal to or less than 4.0 mm, and particularly preferably equal to or less than 3.5 mm.

The core 64 has a diameter of preferably 38.4 mm or greater and 41.0 mm or less. The core 64 having a diameter of equal to or greater than 38.4 mm is sufficiently deformed when the golf ball 62 is hit by a driver. By the sufficient deformation, spin on a driver shot can be suppressed. In this respect, the diameter is more preferably equal to or greater than 38.8 mm, and particularly preferably equal to or greater than 39.4 mm. The core 64 having a diameter of equal to or less than 41.0 mm is excellent in durability. In this respect, the diameter is more preferably equal to or less than 40.4 mm, and particularly preferably equal to or less than 40.0 mm.

The weight of the core 64 is preferably 35.0 g or greater and 44.5 g or less. Crosslinking temperature of the core 64 is usually 140° C. or greater and 180° C. or less. The crosslinking time period of the core 64 is usually 10 minutes or longer and 60 minutes or less. The core may have two or more layers.

The cover 66 is formed by a thermoplastic resin composition. Examples of the base polymer of this resin composition include ionomer resins, styrene block-containing thermoplastic elastomers, thermoplastic polyurethane elastomers, thermoplastic polyester elastomers, thermoplastic polyamide elastomers and thermoplastic polyolefin elastomers.

In particular, ionomer resins are preferred. The ionomer resins are highly elastic. By using the ionomer resins, excellent resilience performance of the golf ball 62 can be achieved. An ionomer resin which is equivalent to the inomomer resin used for the cover 6 shown in FIG. 1 can be used for the cover 66.

Preferably, an ionomer resin having a material hardness (Shore D) of 40 or greater and 70 or less is used. The ionomer resin having the material hardness of equal to or greater than 40 is responsible for resilience performance of the golf ball 62. In light of resilience performance, the ionomer resin has the material hardness of more preferably equal to or greater than 45, and particularly preferably equal to or greater than 50. The ionomer resin having the material hardness of equal to or less than 70 is responsible for feel at impact of the golf ball 62. In light of feel at impact, the ionomer resin has the material hardness of more preferably equal to or less than 67, and particularly preferably equal to or less than 65.

It is preferred that the ionomer resin and styrene block-containing thermoplastic elastomer are used in combination. This elastomer is excellent in compatibility with the ionomer resin. An elastomer which is equivalent to the elastomer used for the cover 6 shown in FIG. 1 can be used for the cover 66. This elastomer is responsible for feel at impact and strength of the golf ball 62.

Preferably, styrene block-containing thermoplastic elastomer having a material hardness (JIS-A) of less than 40 is used. This elastomer can be responsible for feel at impact. By using this elastomer, both resilience performance and feel at impact of the golf ball 62 can be achieved. In this respect, the material hardness is more preferably less than 30, and particularly preferably less than 20. The material hardness is preferably equal to or greater than 3.

The material hardness of styrene block-containing thermoplastic elastomer measured by a Shore D type hardness scale is preferably less than 10, more preferably less than 9, and particularly preferably less than 8.

In the instance that the ionomer resin and the styrene block-containing thermoplastic elastomer are used in combination, weight ratio of them is preferably equal to or greater than 40/60, more preferably equal to or greater than 45/55, and particularly preferably equal to or greater than 50/50, in light of resilience performance. In light of feel at impact, the ratio is preferably equal to or less than 95/5, more preferably equal to or less than 90/10, and particularly preferably equal to or less than 85/15.

A thermoplastic polyurethane elastomer is also suitable for the cover 66. This elastomer is soft. When the golf ball 62 which has the cover 66 formed by this elastomer is hit by a short iron, high spin rate is obtained. The cover 66 formed by this elastomer is responsible for control performance on shot by a short iron. This elastomer is also responsible for scuff resistance of the cover 66. Further, by this elastomer, excellent feel at impact can be achieved when the golf ball 62 is hit by a putter or a short iron.

Other resin may be used in combination with the thermoplastic polyurethane elastomer. In light of the spin performance, the thermoplastic polyurethane elastomer is included in the base polymer as a principal component in the case of use in combination. A proportion of the thermoplastic polyurethane elastomer to total base polymer is preferably equal to or greater than 50% by weight, more preferably equal to or greater than 70% by weight, and particularly preferably equal to or greater than 85% by weight.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate. In particular, alicyclic diisocyanate is preferred. Because the alicyclic diisocyanate has no double bond in the main chain, yellowing of the cover 66 can be suppressed. Additionally, because the alicyclic diisocyanate is excellent in strength, the cover 66 can be prevented from being scuffed. Two or more kinds of the diisocyanate may be used in combination.

Illustrative examples of the alicyclic diisocyanate include 4,4'-dicyclohexylmethane diisocyanate ($H_{12}MDI$), 1,3-bis (isocyanatomethyl)cyclohexane ($H_6XDI$), isophorone diisocyanate (IPDI) and trans-1,4-cyclohexane diisocyanate (CHDI). In light of versatility and processability, $H_{12}MDI$ is preferred.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Preferably, the thermoplastic polyurethane elastomer having a material hardness (Shore D) of equal to or less than 50 is used. By this elastomer, small hardness H4 of the cover 66 can be achieved. In light of possible suppression of excessive spin, it is preferred the material hardness is equal to or greater than 20, and further, equal to or greater than 26. The measuring method of the material hardness of the thermoplastic polyurethane elastomer is the same as that of the material hardness of the ionomer resin.

Specific examples of the thermoplastic polyurethane elastomer include trade names "Elastolan XNY80A", "Elastolan XNY85A", "Elastolan XNY90A", "Elastolan XNY97A", "Elastolan XNY585" and "Elastolan XKPO16N", available from BASF Japan Ltd; and trade name "Rezamin P4585LS" and "Rezamin PS62490", available from Dainichiseika Color & Chemicals Mfg. Co., Ltd.

The cover 66 has a hardness H4 of less than 90. By this cover 66, high spin rate is achieved when the golf ball 62 is hit by a short iron. This cover 66 is responsible for control performance. In this respect, the hardness H4 is preferably less than 88, more preferably less than 86, and particularly preferably less than 80. In light of resilience performance, the hardness H4 is preferably equal to or greater than 40, and particularly preferably equal to or greater than 50.

The cover may consist of two or more layers. In this instance, the aforementioned hardness H4 is defined as a hardness of the outer cover. In the instance that the cover consists of two or more layers, the outer cover has a hardness H4 of particularly preferably less than 80.

In the instance that the cover consists of two or more layers, the second layer from the outside is referred to as an "inner cover". The inner cover has a hardness H3 of preferably 90 or greater and less than 100. The inner cover having a hardness H3 of equal to or greater than 90 is responsible for resilience performance. In this respect, the hardness H3 is more preferably equal to or greater than 92, and particularly preferably equal to or greater than 94. The inner cover having the hardness H3 of less than 100 does not deteriorate durability of the golf ball. In this respect, the hardness H3 is particularly preferably less than 98.

The cover 66 has a thickness of less than 2.2 mm. This cover 66 is thin. When this golf ball 62 is hit by a driver, the core 64 is sufficiently deformed. By the sufficient deformation, great resilience performance is achieved and spin is suppressed. In this respect, the thickness is more preferably less than 1.8 mm, and particularly preferably less than 1.6 mm. In light of durability of the golf ball 62, the thickness is preferably equal to or greater than 0.2 mm, and particularly preferably equal to or greater than 0.4 mm. The thickness of the cover 66 is measured immediately below the land 10. In the instance that the cover consists of two or more layers, the total thickness of all layers is set to be within the range above.

In the instance that the cover consists of two or more layers, the outer cover has a thickness of preferably 0.1 mm or greater and less than 1.6 mm. The layer having a thickness of equal to or greater than 0.1 mm can be responsible for control performance when the golf ball is hit by a short iron club. In this respect, the thickness is particularly preferably equal to or greater than 0.2 mm. The outer cover having a thickness of less than 1.6 mm does not deteriorate resilience performance of the golf ball. In this respect, the thickness is preferably less than 1.2 mm, and particularly preferably less than 0.8 mm.

In the instance that the cover consists of two or more layers, the inner cover has a thickness of 0.1 mm or greater and 1.6 mm or less. The inner cover having a thickness of equal to or greater than 0.1 mm can be responsible for durability of the golf ball. In this respect, the thickness is particularly preferably equal to or greater than 0.3 mm. The inner cover having a thickness of equal to or less than 1.6 mm does not interfere deformation of the core 64. In this respect, the thickness is preferably equal to or less than 1.3 mm, and particularly preferably equal to or less than 1.0 mm.

The golf ball 62 has a surface hardness H5 of preferably 70 or greater and 95 or less. By the golf ball 62 having the surface hardness H5 of equal to or greater than 70 is excellent in resilience performance on a driver shot. In this respect, the surface hardness H5 is more preferably equal to or greater than 75, and particularly preferably equal to or greater than 80. The golf ball 62 having the surface hardness H5 of equal to or less than 95 is excellent in control performance when being hit by a short iron. In this respect, the surface hardness H5 is particularly preferably equal to or less than 90. The surface hardness H5 is measured by pressing a JIS-C type spring hardness scale on a surface of the golf ball 62. For the measurement, an automated rubber hardness tester (trade name "P1", available from Koubunshi Keiki Co., Ltd.) which is equipped with this hardness scale is used. The surface hardness H5 is measured on the golf ball 62 which does not have any paint. The golf ball 62 from which a paint layer is removed may be used for the measurement.

A sum (H2+H5) of the surface hardness H2 of the core and the surface hardness H5 of the golf ball is preferably 150 or greater and 180 or less. The golf ball having the sum (H2+H5) of equal to or greater than 150 is excellent in resilience performance on a driver shot. In this respect, the sum (H2+H5) is more preferably equal to or greater than 155, and particularly preferably equal to or greater than 160. The golf ball 62 having the sum (H2+H5) of equal to or less than 180 is excellent in control performance when being hit by a short iron. In this respect, the sum (H2+H5) is particularly preferably equal to or less than 170.

The amount of compressive deformation of the golf ball 62 is preferably 2.0 mm or greater and 3.6 mm or less. The golf ball 62 having the amount of compressive deformation of equal to or greater than 2.0 mm is excellent in feel at impact. In this respect, the amount of compressive deformation is particularly preferably equal to or greater than 2.3 mm. The golf ball 62 having the amount of compressive deformation of equal to or less than 3.6 mm is excellent in resilience performance. In this respect, the amount of compressive deformation is particularly preferably equal to or less than 3.3 mm.

The dimple pattern of this golf ball 62 is the same as that of the golf ball 2 shown in FIGS. 1 to 8. The dimple patterns shown in FIGS. 9 to 12 may be employed to the golf ball 62. The dimple patterns shown in FIGS. 13 to 14 may be employed to the golf ball 62.

EXAMPLES

Experiment 1

Example 1

A rubber composition was obtained by kneading 100 parts by weight of polybutadiene (trade name "BR-730", available from JSR Corporation) which is synthesized using a rare earth element catalyst, 26 parts by weight of zinc diacrylate, 10 parts by weight of zinc oxide, an adequate amount of barium sulfate, 0.5 part by weight of diphenyl disulfide and 0.5 part by weight of dicumyl peroxide (manufactured by NOF Corporation). This rubber composition was placed into a mold having upper and lower mold half each having a hemispherical cavity, and heated at 170° C. for 20 minutes to obtain a core. The core had a diameter of 39.2 mm. On the other hand, a resin composition was obtained by kneading 57 parts by weight of ionomer resin (the aforementioned "Himilan 1605"), 40 parts by weight of another ionomer resin (the aforementioned "Himilan 1706"), 3 parts by weight of styrene block-containing thermoplastic elastomer (the aforementioned "Rabalon® T3221C") and 3 parts by weight of titanium dioxide. The core was placed into a final mold having numerous pimples on the inside face, followed by injection of the aforementioned resin composition around the core by injection molding to form a cover. A thickness of the cover was 1.75 mm. Numerous dimples having a shape inverted from the shape of the pimples were formed on the cover. A paint layer was formed around this cover to give a golf ball of Example 1. This golf ball had a diameter of 42.7 mm and a weight of 45.4 g. This golf ball has a dimple pattern of type I shown in table 3 below.

Examples 2 to 8 and Comparative Examples 1 to 6

In a similar manner to Example 1 except that the specifications of the core, the cover and the dimples were set as shown in tables 4 to 7 below, golf balls of Examples 2 to 8 and Comparative Examples 1 to 6 were obtained. Details of compositions of the core are shown in table 1 below. Details of compositions of the cover are shown in table 2 below. Specifications of the dimples are shown in table 3 below.

[Measurement of Resilience Coefficient]

To the golf ball was impacted a hollow cylinder made of aluminum the weight of which being 200 g at a velocity of 45 m/s. Then, velocity of the hollow cylinder prior to and after the impact, and the velocity of the golf ball after the impact were measured to determine the resilience coefficient of the golf ball. A mean value obtained by 12 times measurement is shown as an index in table 4 to 7 below.

[Flight Distance by Driver]

A driver with a metal head (trade name "XXIO", available from SRI Sports Limited, shaft hardness: S, loft angle: 10°) was attached to a swing machine available from Golf Laboratory Co. Then the golf balls were hit under a condition to give the head speed of 45 m/sec, and distance from the launching point to the point where the ball stopped was measured. Mean values of 12 times measurement are shown in tables 4 to 7 below.

[Flight Distance by Iron Club]

An iron club (#5) with a face formed by titanium alloy (trade name "XXIO", available from SRI Sports Limited, shaft hardness: S) was attached to the swing machine described above. Then the golf balls were hit under a condition to give the head speed of 38 m/sec, and distance from the launching point to the point where the ball stopped was measured. Mean values of 12 times measurement are shown in tables 4 to 7 below.

[Evaluation of Feel at Impact]

Using a driver, golf balls were hit by 10 high class golf players, and feel at impact was evaluated. The golf balls were rated according to the number of the golf players who judged "good feel at impact" was obtained with the golf ball.

A: 8 or more

B: 6 to 7

C: 4 to 5

D: 3 or less

The results are shown in tables 4 to 7 below.

TABLE 1

Compositions of Core

| Type | a | b | c (parts by weight) |
|---|---|---|---|
| BR-730 | 100 | 100 | 100 |
| Zinc diacrylate | 26.0 | 28.0 | 24.5 |
| Zinc oxide | 10 | 10 | 10 |
| Barium sulfate* | adequate amount | adequate amount | adequate amount |

TABLE 1-continued

Compositions of Core

| Type | a | b | c (parts by weight) |
|---|---|---|---|
| Diphenyl disulfide | 0.5 | 0.5 | 0.5 |
| Dicumyl peroxide | 0.7 | 0.7 | 0.7 |

*adjusted so that golf balls have a weight of 45.4 g

TABLE 2

Compositions of Cover

| Type | d | e | f | g (parts by weight) |
|---|---|---|---|---|
| Himilan 1605 material hardness: 61(Shore D) | 57 | — | 60 | 30 |
| Himilan 1706 material hardness: 60(Shore D) | 40 | — | — | 30 |
| Rabalon T3221C material hardness: 20(JIS-A) | 3 | 10 | — | 40 |
| Himilan 1555 material hardness: 57(Shore D) | — | 50 | — | — |
| Himilan 1557 material hardness: 57(Shore D) | — | 40 | 40 | — |
| Titanium dioxide | 3 | 3 | 3 | 3 |

TABLE 3

Specifications of Dimples

Figure 16:
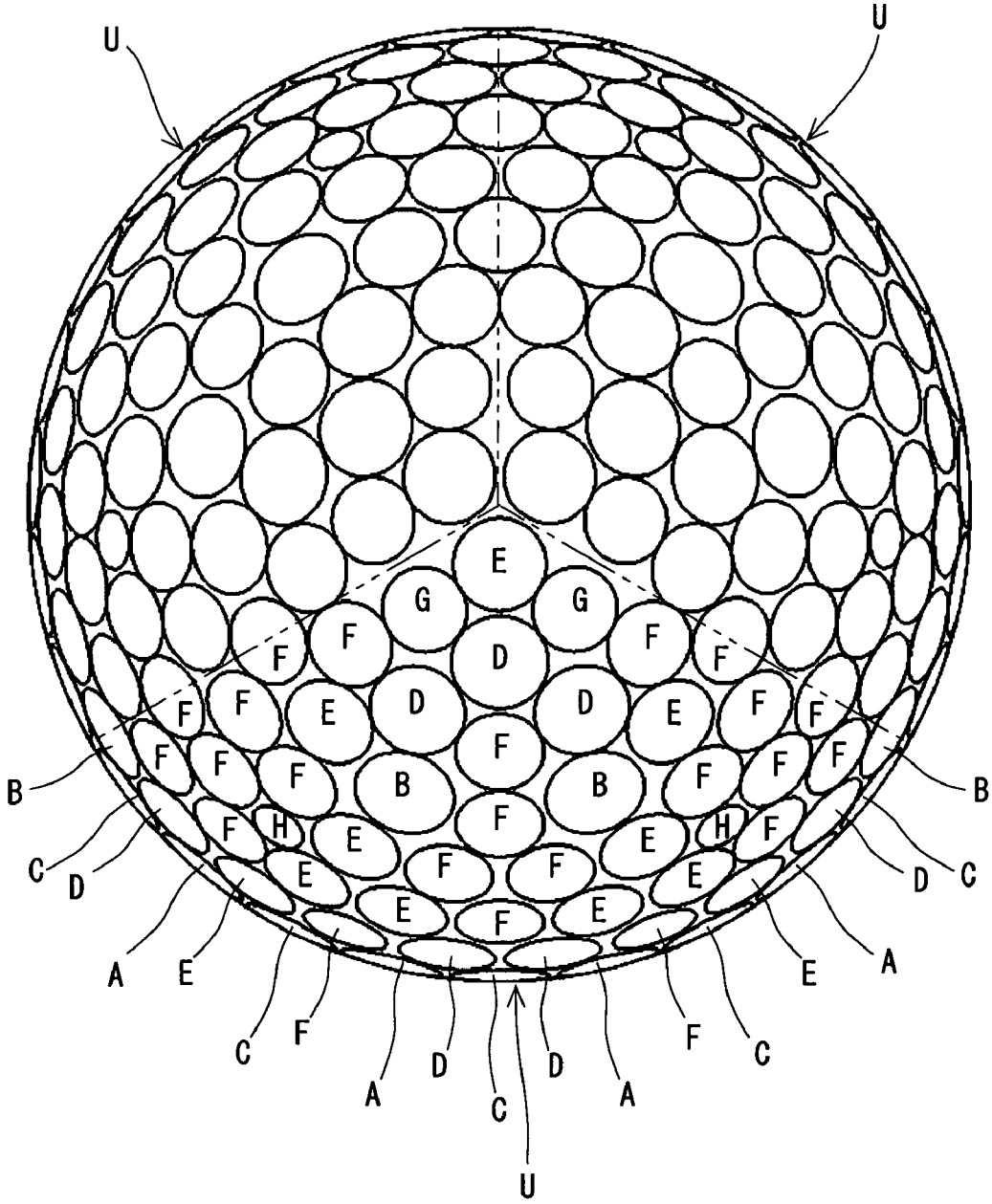
FIG. 16 shows a plan view illustrating a golf ball according to Comparative Example 1.
Figure 17:
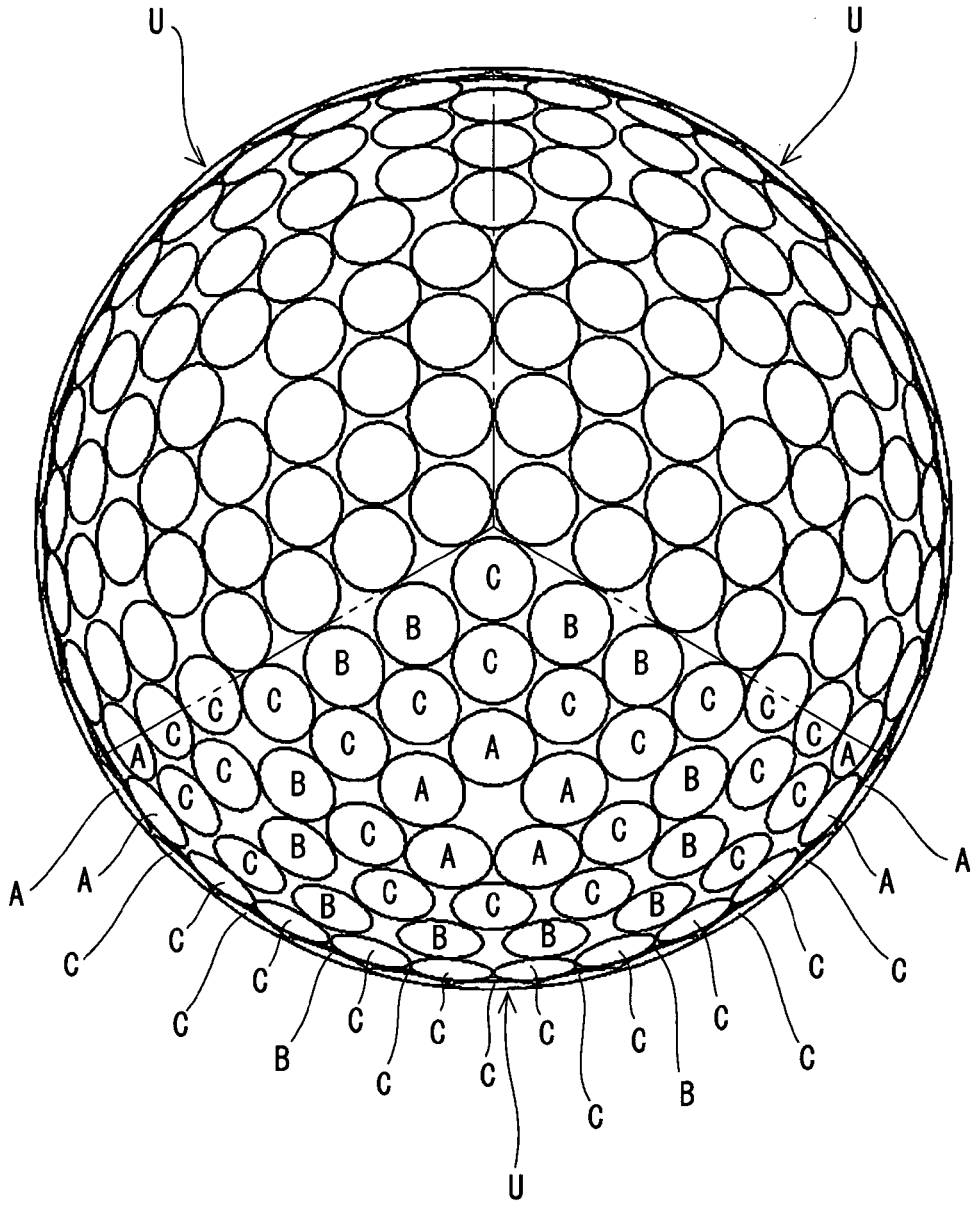
FIG. 17 shows a plan view illustrating a golf ball according to Comparative Example 2.

| Type | Kind | Number | Diameter Di (mm) | Depth (mm) | Curvature radius (mm) | Volume ($mm^3$) | Total volume ($mm^3$) | FIG. |
|---|---|---|---|---|---|---|---|---|
| I | A | 60 | 4.500 | 0.1410 | 18.02 | 1.123 | 316.0 | FIGS. 2, 6-8 |
| | B | 86 | 4.400 | 0.1400 | 17.36 | 1.066 | | |
| | C | 56 | 4.300 | 0.1400 | 16.58 | 1.018 | | |
| | D | 10 | 4.100 | 0.1400 | 15.08 | 0.926 | | |
| | E | 76 | 4.000 | 0.1400 | 14.36 | 0.881 | | |
| | F | 22 | 3.500 | 0.1400 | 11.01 | 0.675 | | |
| | G | 18 | 3.000 | 0.1400 | 8.11 | 0.496 | | |
| II | A | 80 | 4.600 | 0.1360 | 19.52 | 1.131 | 315.9 | FIGS. 9-12 |
| | B | 60 | 4.450 | 0.1360 | 18.27 | 1.059 | | |
| | C | 62 | 4.300 | 0.1360 | 17.06 | 0.989 | | |
| | D | 58 | 4.100 | 0.1360 | 15.52 | 0.899 | | |
| | E | 38 | 3.900 | 0.1350 | 14.15 | 0.808 | | |
| | F | 18 | 3.400 | 0.1350 | 10.77 | 0.614 | | |
| | G | 14 | 3.000 | 0.1350 | 8.40 | 0.478 | | |
| III | A | 80 | 4.555 | 0.1390 | 18.73 | 1.134 | 316.2 | FIGS. 9-12 |
| | B | 60 | 4.405 | 0.1390 | 17.52 | 1.061 | | |
| | C | 62 | 4.255 | 0.1390 | 16.35 | 0.990 | | |
| | D | 58 | 4.055 | 0.1390 | 14.86 | 0.899 | | |
| | E | 38 | 3.855 | 0.1380 | 13.53 | 0.807 | | |
| | F | 18 | 3.355 | 0.1380 | 10.26 | 0.611 | | |
| | G | 14 | 2.955 | 0.1380 | 7.98 | 0.475 | | |
| IV | A | 332 | 4.318 | 0.1300 | 17.99 | 0.953 | 316.4 | FIGS. 13-14 |
| V | A | 24 | 4.700 | 0.1400 | 19.79 | 1.216 | 316.1 | FIG. 16 |
| | B | 18 | 4.600 | 0.1400 | 18.96 | 1.165 | | |
| | C | 30 | 4.500 | 0.1390 | 18.28 | 1.107 | | |
| | D | 42 | 4.400 | 0.1390 | 17.48 | 1.058 | | |
| | E | 66 | 4.200 | 0.1390 | 15.93 | 0.964 | | |
| | F | 126 | 4.000 | 0.1390 | 14.46 | 0.875 | | |
| | G | 12 | 3.900 | 0.1390 | 13.75 | 0.832 | | |
| | H | 12 | 2.600 | 0.1390 | 6.15 | 0.370 | | |
| VI | A | 60 | 4.100 | 0.1450 | 14.56 | 0.959 | 315.9 | FIG. 17 |
| | B | 84 | 4.000 | 0.1440 | 13.96 | 0.906 | | |
| | C | 216 | 3.900 | 0.1410 | 13.55 | 0.844 | | |

TABLE 4

Results of Evaluation

| | | | Example 1 | Example 2 | Example 3 | Example 4 |
|---|---|---|---|---|---|---|
| Core | Type of composition | | a | a | a | a |
| | Crosslinking temperature (° C.) | | 170 | 170 | 170 | 170 |
| | Crosslinking time period (min) | | 20 | 20 | 20 | 20 |
| | Diameter (mm) | | 39.2 | 39.2 | 39.2 | 39.2 |
| | Compressive deformation (mm) | | 4.1 | 4.1 | 4.1 | 4.1 |
| | Central hardness H1 (JIS-C) | | 58 | 58 | 58 | 58 |
| | Surface hardness H2 (JIS-C) | | 76 | 76 | 76 | 76 |
| | Difference H2 − H1 (JIS-C) | | 18 | 18 | 18 | 18 |
| Inner layer of cover | Type of composition | | — | — | — | — |
| | Hardness (JIS-C) | | — | — | — | — |
| | Thickness (mm) | | — | — | — | — |
| Outermost layer of cover | Type of composition | | d | d | d | d |
| | Hardness H4 (JIS-C) | | 92 | 92 | 92 | 92 |
| | Thickness (mm) | | 1.75 | 1.75 | 1.75 | 1.75 |
| Thickness of cover (mm) | | | 1.75 | 1.75 | 1.75 | 1.75 |
| Dimple | Type | | I | II | III | IV |
| | Total number N | | 328 | 330 | 330 | 332 |
| | Mean diameter Da (mm) | | 4.16 | 4.21 | 4.17 | 4.32 |
| | Number of adjacent dimple pairs | | 1382 | 1476 | 1492 | 1450 |
| | Occupation ratio (%) | | 78.6 | 81.1 | 79.4 | 84.9 |
| | Number of great circle band | | 0 | 1 | 1 | 1 |
| | Number N1 | | 914 | 964 | 960 | 990 |
| | Ratio (N1/N) | | 2.79 | 2.92 | 2.91 | 2.98 |
| | Number N2 | | 546 | 614 | 514 | 540 |
| | Ratio (N2/N1) | | 0.60 | 0.64 | 0.54 | 0.55 |
| | Number N3 | | 12 | 58 | 0 | 260 |
| | Ratio (N3/N1) | | 0.013 | 0.060 | 0 | 0.263 |
| Pole vicinity region | Rotation symmetry angle (deg.) | | 72 | 72 | 72 | — |
| | Number of units Np | | 5 | 5 | 5 | — |
| Coordination region | | | Line symmetry | Line symmetry | Line symmetry | — |
| Equator vicinity region | | Rotation symmetry angle (deg.) | 60 | 60 | 60 | — |
| | | Number of units Ne | 6 | 6 | 6 | — |
| Northern and southern hemispheres | | Rotation symmetry angle (deg.) | — | — | — | 72 |
| | | Number of units | — | — | — | 5 |
| Difference H4 − H1 (JIS-C) | | | 34 | 34 | 34 | 34 |
| Difference H4 − H2 (JIS-C) | | | 16 | 16 | 16 | 16 |
| Amount of compressive deformation of ball (mm) | | | 3.3 | 3.3 | 3.3 | 3.3 |
| Resilience coefficient (index) | | | 1.01 | 1.01 | 1.01 | 1.01 |
| Flight distance by driver (m) | | | 232 | 233.5 | 231.5 | 230.5 |
| Flight distance by #5 iron club (m) | | | 165 | 166 | 164.5 | 164 |
| Feel at impact | | | A | A | A | A |

TABLE 5

Results of Evaluation

| | | Comp. Example 1 | Comp. Example 2 | Example 5 | Example 6 |
|---|---|---|---|---|---|
| Core | Type of composition | a | a | b | c |
| | Crosslinking temperature (° C.) | 170 | 170 | 170 | 170 |
| | Crosslinking time period (min) | 20 | 20 | 20 | 20 |
| | Diameter (mm) | 39.2 | 39.2 | 40.1 | 38.9 |
| | Compressive deformation (mm) | 4.1 | 4.1 | 3.6 | 4.4 |
| | Central hardness H1 (JIS-C) | 58 | 58 | 63 | 56 |
| | Surface hardness H2 (JIS-C) | 76 | 76 | 82 | 74 |
| | Difference H2 − H1 (JIS-C) | 18 | 18 | 19 | 18 |
| Inner layer of cover | Type of composition | — | — | — | — |
| | Hardness (JIS-C) | — | — | — | — |
| | Thickness (mm) | — | — | — | — |
| Outermost layer of cover | Type of composition | d | d | d | f |
| | Hardness H4 (JIS-C) | 92 | 92 | 92 | 91 |
| | Thickness (mm) | 1.75 | 1.75 | 1.3 | 1.9 |
| Thickness of cover (mm) | | 1.75 | 1.75 | 1.3 | 1.9 |
| Dimple | Type | V | VI | II | III |
| | Total number N | 330 | 360 | 330 | 330 |
| | Mean diameter Da (mm) | 4.17 | 3.96 | 4.21 | 4.17 |
| | Number of adjacent dimple pairs | 1410 | 1410 | 1476 | 1492 |
| | Occupation ratio (%) | 79.2 | 77.3 | 81.1 | 79.4 |
| | Number of great circle band | 1 | 1 | 1 | 1 |

TABLE 5-continued

Results of Evaluation

| | | Comp. Example 1 | Comp. Example 2 | Example 5 | Example 6 |
|---|---|---|---|---|---|
| | Number N1 | 960 | 954 | 964 | 960 |
| | Ratio (N1/N) | 2.91 | 2.65 | 2.92 | 2.91 |
| | Number N2 | 462 | 600 | 614 | 514 |
| | Ratio (N2/N1) | 0.48 | 0.63 | 0.64 | 0.54 |
| | Number N3 | 42 | 24 | 58 | 0 |
| | Ratio (N3/N1) | 0.044 | 0.025 | 0.060 | 0 |
| Pole vicinity region | Rotation symmetry angle (deg.) | — | — | 72 | 72 |
| | Number of units Np | — | — | 5 | 5 |
| Coordination region | | — | — | Line symmetry | Line symmetry |
| Equator vicinity region | Rotation symmetry angle (deg.) | — | — | 60 | 60 |
| | Number of units Ne | — | — | 6 | 6 |
| Northern and southern hemispheres | Rotation symmetry angle (deg.) | 120 | 120 | — | — |
| | Number of units | 3 | 3 | — | — |
| Difference H4 − H1 (JIS-C) | | 34 | 34 | 29 | 35 |
| Difference H4 − H2 (JIS-C) | | 16 | 16 | 10 | 17 |
| Amount of compressive deformation of ball (mm) | | 3.3 | 3.3 | 3.1 | 3.4 |
| Resilience coefficient (index) | | 1.01 | 1.01 | 1.02 | 1.00 |
| Flight distance by driver (m) | | 229 | 228 | 235 | 231 |
| Flight distance by #5 iron club (m) | | 163 | 162 | 164 | 168 |
| Feel at impact | | A | A | B | B |

TABLE 6

Results of Evaluation

| | | Example 7 | Example 8 | Comp. Example 3 |
|---|---|---|---|---|
| Core | Type of composition | b | a | a |
| | Crosslinking temperature (° C.) | 170 | 160 | 170 |
| | Crosslinking time period (min) | 20 | 22 | 20 |
| | Diameter (mm) | 38.1 | 39.2 | 39.2 |
| | Compressive deformation (mm) | 3.6 | 4.0 | 4.1 |
| | Central hardness H1 (JIS-C) | 63 | 61 | 58 |
| | Surface hardness H2 (JIS-C) | 82 | 73 | 76 |
| | Difference H2 − H1 (JIS-C) | 19 | 12 | 18 |
| Inner layer of cover | Type of composition | g | — | — |
| | Hardness (JIS-C) | 1.0 | — | — |
| | Thickness (mm) | 75 | — | — |
| Outermost layer of cover | Type of composition | d | d | e |
| | Hardness H4 (JIS-C) | 92 | 92 | 87 |
| | Thickness (mm) | 1.3 | 1.75 | 1.75 |
| Thickness of cover (mm) | | 2.3 | 1.75 | 1.75 |
| Dimple | Type | II | II | I |
| | Total number N | 330 | 330 | 328 |
| | Mean diameter Da (mm) | 4.21 | 4.21 | 4.16 |
| | Number of adjacent dimple pairs | 1476 | 1476 | 1382 |
| | Occupation ratio (%) | 81.1 | 81.1 | 78.6 |
| | Number of great circle band | 1 | 1 | 0 |
| | Number N1 | 964 | 964 | 914 |
| | Ratio (N1/N) | 2.92 | 2.92 | 2.79 |
| | Number N2 | 614 | 614 | 546 |
| | Ratio (N2/N1) | 0.64 | 0.64 | 0.60 |
| | Number N3 | 58 | 58 | 12 |
| | Ratio (N3/N1) | 0.060 | 0.060 | 0.013 |
| Pole vicinity region | Rotation symmetry angle (deg.) | 72 | 72 | 72 |
| | Number of units Np | 5 | 5 | 5 |
| Coordination region | | Line symmetry | Line symmetry | Line symmetry |
| Equator vicinity region | Rotation symmetry angle (deg.) | 60 | 60 | 60 |
| | Number of units Ne | 6 | 6 | 6 |
| Northern and southern hemispheres | Rotation symmetry angle (deg.) | — | — | — |
| | Number of units | — | — | — |
| Difference H4 − H1 (JIS-C) | | 29 | 31 | 29 |
| Difference H4 − H2 (JIS-C) | | 10 | 19 | 11 |
| Amount of compressive deformation of ball (mm) | | 3.2 | 3.2 | 3.4 |
| Resilience coefficient (index) | | 1.02 | 1.01 | 1.00 |
| Flight distance by driver (m) | | 236 | 233 | 230 |

TABLE 6-continued

Results of Evaluation

| | Example 7 | Example 8 | Comp. Example 3 |
|---|---|---|---|
| Flight distance by #5 iron club (m) | 165 | 165 | 163 |
| Feel at impact | A | A | A |

TABLE 7

Results of Evaluation

| | | Comp. Example 4 | Comp. Example 5 | Comp. Example 6 |
|---|---|---|---|---|
| Core | Type of composition | b | c | a |
| | Crosslinking temperature (° C.) | 152 | 155 | 170 |
| | Crosslinking time period (min) | 25 | 25 | 20 |
| | Diameter (mm) | 39.2 | 38.9 | 39.5 |
| | Compressive deformation (mm) | 3.4 | 4.3 | 4.1 |
| | Central hardness H1 (JIS-C) | 69 | 60 | 58 |
| | Surface hardness H2 (JIS-C) | 77 | 70 | 76 |
| | Difference H2 − H1 (JIS-C) | 8 | 10 | 18 |
| Inner layer of cover | Type of composition | — | — | g |
| | Hardness (JIS-C) | — | — | 1.6 |
| | Thickness (mm) | — | — | 75 |
| Outermost layer of cover | Type of composition | d | d | d |
| | Hardness H4 (JIS-C) | 92 | 92 | 92 |
| | Thickness (mm) | 1.75 | 1.9 | 1.6 |
| Thickness of cover (mm) | | 1.75 | 1.9 | 3.2 |
| Dimple | Type | I | V | V |
| | Total number N | 328 | 330 | 330 |
| | Mean diameter Da (mm) | 4.16 | 4.17 | 4.17 |
| | Number of adjacent dimple pairs | 1382 | 1410 | 1410 |
| | Occupation ratio (%) | 78.6 | 79.2 | 79.2 |
| | Number of great circle band | 0 | 1 | 1 |
| | Number N1 | 914 | 960 | 960 |
| | Ratio (N1/N) | 2.79 | 2.91 | 2.91 |
| | Number N2 | 546 | 462 | 462 |
| | Ratio (N2/N1) | 0.60 | 0.48 | 0.48 |
| | Number N3 | 12 | 42 | 42 |
| | Ratio (N3/N1) | 0.013 | 0.044 | 0.044 |
| Pole vicinity region | Rotation symmetry angle (deg.) | 72 | — | — |
| | Number of units Np | 5 | — | — |
| Coordination region | | Line symmetry | — | — |
| Equator vicinity region | Rotation symmetry angle (deg.) | 60 | — | — |
| | Number of units Ne | 6 | — | — |
| Northern and southern hemispheres | Rotation symmetry angle (deg.) | — | 120 | 120 |
| | Number of units | — | 3 | 3 |
| Difference H4 − H1 (JIS-C) | | 23 | 32 | 34 |
| Difference H4 − H2 (JIS-C) | | 15 | 22 | 16 |
| Amount of compressive deformation of ball (mm) | | 3.1 | 3.3 | 3.5 |
| Resilience coefficient (index) | | 1.02 | 1.01 | 0.99 |
| Flight distance by driver (m) | | 232 | 228 | 229 |
| Flight distance by #5 iron club (m) | | 160 | 162 | 164 |
| Feel at impact | | D | A | A |

As shown in tables 4 to 7, the golf balls in each Example are excellent in flight performance and feel at impact.

Experiment 2

Example 9

A rubber composition was obtained by kneading 100 parts by weight of polybutadiene (trade name "BR-730", available from JSR Corporation) which is synthesized using a rare earth element catalyst, 29 parts by weight of zinc diacrylate, 10 parts by weight of zinc oxide, an adequate amount of barium sulfate, 0.5 part by weight of diphenyl disulfide and 0.5 part by weight of dicumyl peroxide (manufactured by NOF Corporation). This rubber composition was placed into a mold having upper and lower mold half each having a hemispherical cavity, and heated at 170° C. for 20 minutes to obtain a core. The core had a diameter of 39.2 mm. On the other hand, a resin composition was obtained by kneading 45 parts by weight of ionomer resin (the aforementioned "Himilan 1605"), 40 parts by weight of another ionomer resin (the aforementioned "Himilan 1706"), 15 parts by weight of styrene block-containing thermoplastic elastomer (the aforementioned "Rabalon® T3221C") and 3 parts by weight of titaniumdioxide. The core was placed into a final mold having numerous pimples on the inside face, followed by injection of the aforementioned resin composition around the core by injection molding to form a cover. A thickness of the cover was 1.6 mm. Numerous dimples having a shape inverted from the shape of the pimples were formed on the cover. A paint layer was formed around this cover to give a golf ball of Example 9. This golf ball had a diameter of 42.7 mm and a weight of 45.4 g. This golf ball has a dimple pattern of type I shown in table 3 above.

Examples 10 to 18 and Comparative Examples 7 to 12

In a similar manner to Example 9 except that the specifications of the core, the cover and the dimples were set as shown in tables 3 above and tables 10 to 13 below, golf balls of Examples 10 to 18 and Comparative Examples 7 to 12 were obtained. Details of compositions of the core are shown in table 8 below. Details of compositions of the cover are shown in table 9 below. Specifications of the dimples are shown in table 3 above.

[Measurement of Resilience Coefficient]

Using the same method as Experiment 1, resilience coefficient was measured. The results are shown in tables 10 to 13 below.

[Flight Distance by Driver]

Using the same method as Experiment 1, flight distance was measured. The results are shown in tables 10 to 13 below.

[Spin Rate]

A sand wedge was attached to the swing machine described above. Then the golf ball was hit under the condition to provide a head speed of 21 m/sec and back spin rate immediately after the impact was measured. Mean values of 5 times measurement are shown in tables 10 to 13 below.

TABLE 8

Compositions of Core (parts by weight)

| Type | h | i | j |
|---|---|---|---|
| BR-730 | 100 | 100 | 100 |
| Zinc diacrylate | 29 | 34 | 26 |
| Zinc oxide | 10 | 10 | 10 |
| Barium sulfate* | adequate amount | adequate amount | adequate amount |
| Diphenyl disulfide | 0.5 | 0.5 | 0.5 |
| Dicumyl peroxide | 0.7 | 0.7 | 0.7 |

*adjusted so that golf balls have a weight of 45.4 g

TABLE 9

Compositions of Cover (parts by weight)

| Type | k | l | m | n |
|---|---|---|---|---|
| Himilan 1605 material hardness: 61(Shore D) | 45 | 40 | — | 60 |
| Himilan 1706 material hardness: 60(Shore D) | 40 | 35 | — | 40 |
| Rabalon T3221C material hardness: 20(JIS-A) | 15 | 25 | — | — |
| Elastollan XNY97A material hardness: 47(Shore D) | — | — | 100 | — |
| Titanium dioxide | 3 | 3 | 3 | 3 |

TABLE 10

Results of Evaluation

| | | Example 1 | Example 2 | Example 3 | Example 4 |
|---|---|---|---|---|---|
| Core | Type of composition | h | h | h | h |
| | Crosslinking temperature (° C.) | 170 | 170 | 170 | 170 |
| | Crosslinking time period (min) | 20 | 20 | 20 | 20 |
| | Diameter (mm) | 39.5 | 39.5 | 39.5 | 39.5 |
| | Compressive deformation (mm) | 3.6 | 3.6 | 3.6 | 3.6 |
| | Central hardness H1 (JIS-C) | 60 | 60 | 60 | 60 |
| | Surface hardness H2 (JIS-C) | 80 | 80 | 80 | 80 |
| | Difference H2 − H1 (JIS-C) | 20 | 20 | 20 | 20 |
| Inner cover | Type of composition | — | — | — | — |
| | Hardness H3 (JIS-C) | — | — | — | — |
| | Thickness (mm) | — | — | — | — |
| Outer cover | Type of composition | k | k | k | k |
| | Hardness H4 (JIS-C) | 88 | 88 | 88 | 88 |
| | Thickness (mm) | 1.6 | 1.6 | 1.6 | 1.6 |
| Cover | Thickness (mm) | 1.6 | 1.6 | 1.6 | 1.6 |
| Dimple | Type | I | II | III | IV |
| | Total number N | 328 | 330 | 330 | 332 |
| | Mean diameter Da (mm) | 4.16 | 4.21 | 4.17 | 4.32 |
| | Number of adjacent dimple pairs | 1382 | 1476 | 1492 | 1450 |
| | Occupation ratio (%) | 78.6 | 81.1 | 79.4 | 84.9 |
| | Number of great circle band | 0 | 1 | 1 | 1 |
| | Number N1 | 914 | 964 | 960 | 990 |
| | Ratio (N1/N) | 2.79 | 2.92 | 2.91 | 2.98 |
| | Number N2 | 546 | 614 | 514 | 540 |
| | Ratio (N2/N1) | 0.60 | 0.64 | 0.54 | 0.55 |
| | Number N3 | 12 | 58 | 0 | 260 |
| | Ratio (N3/N1) | 0.013 | 0.060 | 0 | 0.263 |
| Pole vicinity region | Rotation symmetry angle (deg.) | 72 | 72 | 72 | — |
| | Number of units Np | 5 | 5 | 5 | — |
| Coordination region | | Line symmetry | Line symmetry | Line symmetry | — |
| Equator vicinity region | Rotation symmetry angle (deg.) | 60 | 60 | 60 | — |
| | Number of units Ne | 6 | 6 | 6 | — |
| Northern and southern hemispheres | Rotation symmetry angle (deg.) | — | — | — | 72 |
| | Number of units | — | — | — | 5 |

TABLE 10-continued

| Results of Evaluation | | | | | |
|---|---|---|---|---|---|
| | | Example 1 | Example 2 | Example 3 | Example 4 |
| Ball | Surface hardness H5 (JIS-C) | 91 | 91 | 91 | 91 |
| | Sum H2 + H5 (JIS-C) | 171 | 171 | 171 | 171 |
| | Compressive deformation (mm) | 3.2 | 3.2 | 3.2 | 3.2 |
| Resilience coefficient (index) | | 1.01 | 1.01 | 1.01 | 1.01 |
| Flight distance (m) | | 234 | 235 | 233 | 232.5 |
| Spin rate (rpm) | | 6250 | 6250 | 6250 | 6250 |

TABLE 11

| Results of Evaluation | | | | | |
|---|---|---|---|---|---|
| | | Comp. Example 1 | Comp. Example 2 | Example 5 | Example 6 |
| Core | Type of composition | h | h | i | h |
| | Crosslinking temperature (° C.) | 170 | 170 | 170 | 170 |
| | Crosslinking time period (min) | 20 | 20 | 20 | 20 |
| | Diameter (mm) | 39.5 | 39.5 | 40.1 | 38.9 |
| | Compressive deformation (mm) | 3.6 | 3.6 | 2.8 | 3.6 |
| | Central hardness H1 (JIS-C) | 60 | 60 | 66 | 60 |
| | Surface hardness H2 (JIS-C) | 80 | 80 | 86 | 80 |
| | Difference H2 − H1 (JIS-C) | 20 | 20 | 20 | 20 |
| Inner cover | Type of composition | — | — | — | n |
| | Hardness H3 (JIS-C) | — | — | — | 93 |
| | Thickness (mm) | — | — | — | 1.2 |
| Outer cover | Type of composition | k | k | l | m |
| | Hardness H4 (JIS-C) | 88 | 88 | 84 | 75 |
| | Thickness (mm) | 1.6 | 1.6 | 1.3 | 0.7 |
| Cover | Thickness (mm) | 1.6 | 1.6 | 1.3 | 1.9 |
| Dimple | Type | V | VI | II | II |
| | Total number N | 330 | 360 | 330 | 330 |
| | Mean diameter Da (mm) | 4.17 | 3.96 | 4.21 | 4.21 |
| | Number of adjacent dimple pairs | 1410 | 1410 | 1476 | 1476 |
| | Occupation ratio (%) | 79.2 | 77.3 | 81.1 | 81.1 |
| | Number of great circle band | 1 | 1 | 1 | 1 |
| | Number N1 | 960 | 954 | 964 | 964 |
| | Ratio (N1/N) | 2.91 | 2.65 | 2.92 | 2.92 |
| | Number N2 | 462 | 600 | 614 | 614 |
| | Ratio (N2/N1) | 0.48 | 0.63 | 0.64 | 0.64 |
| | Number N3 | 42 | 24 | 58 | 58 |
| | Ratio (N3/N1) | 0.044 | 0.025 | 0.060 | 0.060 |
| Pole vicinity region | Rotation symmetry angle (deg.) | — | — | 72 | 72 |
| | Number of units Np | — | — | 5 | 5 |
| Coordination region | | — | — | Line symmetry | Line symmetry |
| Equator vicinity region | Rotation symmetry angle (deg.) | — | — | 60 | 60 |
| | Number of units Ne | — | — | 6 | 6 |
| Northern and southern hemispheres | Rotation symmetry angle (deg.) | 120 | 120 | — | — |
| | Number of units | 3 | 3 | — | — |
| Ball | Surface hardness H5 (JIS-C) | 91 | 91 | 87 | 90 |
| | Sum H2 + H5 (JIS-C) | 171 | 171 | 173 | 170 |
| | Compressive deformation (mm) | 3.2 | 3.2 | 2.6 | 2.7 |
| Resilience coefficient (index) | | 1.01 | 1.01 | 1.02 | 1.03 |
| Flight distance (m) | | 231.5 | 229.5 | 235.5 | 236 |
| Spin rate (rpm) | | 6250 | 6250 | 6420 | 6450 |

TABLE 12

| Results of Evaluation | | | | | |
|---|---|---|---|---|---|
| | | Example 7 | Example 8 | Example 9 | Example 10 |
| Core | Type of composition | h | h | i | i |
| | Crosslinking temperature (° C.n) | 157 | 170 | 170 | 170 |
| | Crosslinking time period (min) | 22 | 20 | 20 | 20 |
| | Diameter (mm) | 39.5 | 39.9 | 41.1 | 40 1 |
| | Compressive deformation (mm) | 3.5 | 3.6 | 2.8 | 2.8 |
| | Central hardness H1 (JIS-C) | 64 | 60 | 66 | 66 |

TABLE 12-continued

Results of Evaluation

| | | | Example 7 | Example 8 | Example 9 | Example 10 |
|---|---|---|---|---|---|---|
| | Surface hardness H2 (JIS-C) | | 76 | 80 | 86 | 86 |
| | Difference H2 − H1 (JIS-C) | | 12 | 20 | 20 | 20 |
| Inner cover | Type of composition | | — | — | — | — |
| | Hardness H3 (JIS-C) | | — | — | — | — |
| | Thickness (mm) | | — | — | — | — |
| Outer cover | Type of composition | | k | m | m | l |
| | Hardness H4 (JIS-C) | | 88 | 75 | 75 | 84 |
| | Thickness (mm) | | 1.6 | 1.4 | 0.8 | 1.3 |
| Cover | Thickness (mm) | | 1.6 | 1.4 | 0.8 | 1.3 |
| Dimple | Type | | II | II | II | IV |
| | Total number N | | 330 | 330 | 330 | 332 |
| | Mean diameter Da (mm) | | 4.21 | 4.21 | 4.21 | 4.32 |
| | Number of adjacent dimple pairs | | 1476 | 1476 | 1476 | 1450 |
| | Occupation ratio (%) | | 81.1 | 81.1 | 81.1 | 84.9 |
| | Number of great circle band | | 1 | 1 | 1 | 1 |
| | Number N1 | | 964 | 964 | 964 | 990 |
| | Ratio (N1/N) | | 2.92 | 2.92 | 2.92 | 2.98 |
| | Number N2 | | 614 | 614 | 614 | 540 |
| | Ratio (N2/N1) | | 0.64 | 0.64 | 0.64 | 0.55 |
| | Number N3 | | 58 | 58 | 58 | 260 |
| | Ratio (N3/N1) | | 0.060 | 0.060 | 0.060 | 0.263 |
| Pole vicinity region | | Rotation symmetry angle (deg.) | 72 | 72 | 72 | — |
| | | (Number of units Np | 5 | 5 | 5 | — |
| Coordination region | | | Line symmetry | Line symmetry | Line symmetry | — |
| Equator vicinity region | | Rotation symmetry angle (deg.) | 60 | 60 | 60 | — |
| | | Number of units Ne | 6 | 6 | 6 | — |
| Northern and southern hemispheres | | Rotation symmetry angle (deg.) | — | — | — | 72 |
| | | Number of units | — | — | — | 5 |
| Ball | Surface hardness H5 (JIS-C) | | 91 | 76 | 82 | 87 |
| | Sum H2 + H5 (JIS-C) | | 167 | 156 | 168 | 173 |
| | Compressive deformation (mm) | | 3.1 | 3.3 | 2.7 | 2.6 |
| Resilience coefficient (index) | | | 1.01 | 0.99 | 1.02 | 1.02 |
| Flight distance (m) | | | 234.5 | 234 | 236 | 233.5 |
| Spin rate (rpm) | | | 6320 | 6550 | 6380 | 6420 |

TABLE 13

Results of Evaluation

| | | Comp. Example 3 | Comp. Example 4 | Comp. Example 5 | Comp. Example 6 |
|---|---|---|---|---|---|
| Core | Type of composition | j | j | h | i |
| | Crosslinking temperature (° C.) | 170 | 150 | 170 | 170 |
| | Crosslinking time period (min) | 20 | 25 | 20 | 20 |
| | Diameter (mm) | 38.1 | 39.5 | 37.5 | 38.9 |
| | Compressive deformation (mm) | 4.2 | 3.9 | 3.6 | 2.8 |
| | Central hardness H1 (JIS-C) | 57 | 64 | 60 | 66 |
| | Surface hardness H2 (JIS-C) | 77 | 72 | 80 | 86 |
| | Difference H2 − H1 (JIS-C) | 20 | 8 | 20 | 20 |
| Inner cover | Type of composition | — | — | k | — |
| | Hardness H3 (JIS-C) | — | — | 88 | — |
| | Thickness (mm) | — | — | 1.6 | — |
| Outer cover | Type of composition | n | m | m | n |
| | Hardness H4 (JIS-C) | 93 | 75 | 75 | 93 |
| | Thickness (mm) | 2.3 | 1.6 | 1.0 | 1.9 |
| Cover | Thickness (mm) | 2.3 | 1.6 | 2.6 | 1.9 |
| Dimple | Type | I | V | V | V |
| | Total number N | 328 | 330 | 330 | 330 |
| | Mean diameter Da (mm) | 4.16 | 4.17 | 4.17 | 4.17 |
| | Number of adjacent dimple pairs | 1382 | 1410 | 1410 | 1410 |
| | Occupation ratio (%) | 78.6 | 79.2 | 79.2 | 79.2 |
| | Number of great circle band | 0 | 1 | 1 | 1 |
| | Number N1 | 914 | 960 | 960 | 960 |
| | Ratio (N1/N) | 2.79 | 2.91 | 2.91 | 2.91 |
| | Number N2 | 546 | 462 | 462 | 462 |
| | Ratio (N2/N1) | 0.60 | 0.48 | 0.48 | 0.48 |
| | Number N3 | 12 | 42 | 42 | 42 |
| | Ratio (N3/N1) | 0.013 | 0.044 | 0.044 | 0.044 |

TABLE 13-continued

Results of Evaluation

| | | Comp. Example 3 | Comp. Example 4 | Comp. Example 5 | Comp. Example 6 |
|---|---|---|---|---|---|
| Pole vicinity region | Rotation symmetry angle (deg.) | 72 | — | — | — |
| | Number of units Np | 5 | — | — | — |
| Coordination region | | Line symmetry | — | — | — |
| Equator vicinity region | Rotation symmetry angle (deg.) | 60 | — | — | — |
| | Number of units Ne | 6 | — | — | — |
| Northern and southern hemispheres | Rotation symmetry angle (deg.) | — | 120 | 120 | 120 |
| | Number of units | — | 3 | 3 | 3 |
| Ball | Surface hardness H5 (JIS-C) | 97 | 76 | 85 | 97 |
| | Sum H2 + H5 (JIS-C) | 174 | 148 | 165 | 183 |
| | Compressive deformation (mm) | 3.4 | 3.5 | 2.9 | 2.3 |
| Resilience coefficient (index) | | 1.00 | 0.98 | 1.01 | 1.03 |
| Flight distance (m) | | 233 | 227 | 232 | 235.5 |
| Spin rate (rpm) | | 5220 | 6510 | 6400 | 5560 |

As shown in tables 10 to 13, the golf balls in each Example are excellent in flight performance and spin performance. Accordingly, advantages of the present invention are clearly indicated by this result of evaluation.

The description herein above is merely for illustrative examples, and various modifications can be made without departing from the principles of the present invention.

What is claimed is:

1. A golf ball which comprises a core, a cover covering this core and numerous dimples formed on the surface of the cover, wherein the cover has a thickness of less than 3.0 mm and a hardness H4 of equal to or greater than 90, a difference (H2−H1) between a surface hardness H2 of the core and a central hardness H1 of the core is 10 or greater and 25 or less, a difference (H4−H1) between a hardness H4 of the cover and the central hardness H1 of the core is equal to or greater than 25, a difference (H4−H2) between the hardness H4 of the cover and the surface hardness H2 of the core is 10 or greater and 20 or less, provided that mean diameter of all dimples is Da, a ratio (N1/N) of a number N1 of adjacent dimple pairs having a pitch of (Da/4) or less to total number N of the dimples is equal to or greater than 2.70, and a ratio (N2/N1) of number N2 of adjacent dimple pairs having a pitch of (Da/20) or less to the number N1 is equal to or greater than 0.50.

2. The golf ball according to claim 1 wherein a base polymer for the cover contains an ionomer resin as a principal component and a thermoplastic elastomer having a material hardness (JIS-A) of less than 25, and a proportion of the thermoplastic elastomer in the total base polymer is 1% by weight or greater and 30% by weight or less.

3. The golf ball according to claim 1 wherein the ratio (N2/N1) is equal to or greater than 0.60.

4. The golf ball according to claim 1 wherein the mean diameter Da is equal to or greater than 4.00 mm, the total number N of the dimples is equal to or less than 362, and a proportion of total are a of all dimples to a surface are a of a phantom sphere is equal to or greater than 75%.

5. The golf ball according to claim 1 wherein each of a northern hemisphere and a southern hemisphere of a surface of the golf ball has a pole vicinity region, an equator vicinity region and a coordination region located between the pole vicinity region and the equator vicinity region, a dimple pattern in the pole vicinity region includes multiple units which are rotationally symmetric to each other centered on a pole point, a dimple pattern in the equator vicinity region includes multiple units which are rotationally symmetric to each other centered on the pole point, a number of the units in the pole vicinity region is different from a number of the units in the equator vicinity region, and a dimple pattern in the coordination region is either a pattern which cannot be comparted into multiple units that are rotationally symmetric to each other centered on the pole point, or a pattern including multiple units that are rotationally symmetric to each other centered on the pole point with a number of the units being different from the numbers of the units in the pole vicinity region and the equator vicinity region.

6. The golf ball according to claim 1 wherein the surface thereof does not have any great circle which does not cross the dimple.

7. A golf ball which comprises a core, a cover including an outer cover and numerous dimples formed on a surface of the outer cover, wherein the outer cover has a hardness H4 of less than 90, the cover has a thickness of less than 2.2 mm, a difference (H2−H1) between a surface hardness H2 of the core and a central hardness H1 of the core is 10 or greater and 25 or less, a sum (H2+H5) of the surface hardness H2 of the core and a surface hardness H5 of the golf ball is 150 or greater and 180 or less, provided that mean diameter of all dimples is Da, a ratio (N1/N) of a number N1 of adjacent dimple pairs having a pitch of (Da/4) or less to total number N of the dimples is equal to or greater than 2.70, and a ratio (N2/N1) of a number N2 of adjacent dimple pairs having a pitch of (Da/20) or less to the number N1 is equal to or greater than 0.50.

8. The golf ball according to claim 7 wherein the outer cover has a thickness of less than 0.8 mm and the outer cover has a hardness H4 of less than 80.

9. The golf ball according to claim 7 wherein the cover further has an inner cover which is positioned inward of the outer cover, the inner cover has a thickness of equal to or less than 1.6 mm, and the inner cover has a hardness H3 of equal to or greater than 90.

10. The golf ball according to claim 7 wherein the ratio (N2/N1) is equal to or greater than 0.60.

11. The golf ball according to claim 7 wherein the mean diameter Da is equal to or greater than 4.00 mm, the total number N of the dimples is equal to or less than 362, and a proportion of total are a of all dimples to a surface are a of a phantom sphere is equal to or greater than 75%.

12. The golf ball according to claim 7 wherein each of a northern hemisphere and a southern hemisphere of a surface of the golf ball has a pole vicinity region, an equator vicinity region and a coordination region located between the pole vicinity region and the equator vicinity region, a dimple pattern in the pole vicinity region includes multiple units which are rotationally symmetric to each other centered on a pole point, a dimple pattern in the equator vicinity region includes multiple units which are rotationally symmetric to each other centered on the pole point, a number of the units in the pole vicinity region is different from a number of the units in the equator vicinity region, and a dimple pattern in the coordination region is either a pattern which cannot be comparted into multiple units that are rotationally symmetric to each other centered on the pole point, or a pattern including multiple units that are rotationally symmetric to each other centered on the pole point with a number of the units being different from the numbers of the units in the pole vicinity region and the equator vicinity region.

13. The golf ball according to claim 7 wherein the surface thereof does not have any great circle which does not cross the dimple.

* * * * *